US010357984B2

(12) United States Patent
Tsuchiya et al.

(10) Patent No.: US 10,357,984 B2
(45) Date of Patent: Jul. 23, 2019

(54) PRINTER

(71) Applicant: FUJITSU COMPONENT LIMITED, Tokyo (JP)

(72) Inventors: Masahiro Tsuchiya, Tokyo (JP); Yukihiro Mori, Tokyo (JP); Sumio Watanabe, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/563,135

(22) PCT Filed: Mar. 28, 2016

(86) PCT No.: PCT/JP2016/059838
§ 371 (c)(1),
(2) Date: Sep. 29, 2017

(87) PCT Pub. No.: WO2016/167108
PCT Pub. Date: Oct. 20, 2016

(65) Prior Publication Data

US 2018/0079242 A1 Mar. 22, 2018

(30) Foreign Application Priority Data

Apr. 15, 2015 (JP) ..... 2015-083273

(51) Int. Cl.
*B41J 29/02* (2006.01)
*B41J 11/04* (2006.01)
(Continued)

(52) U.S. Cl.
CPC ..... *B41J 29/02* (2013.01); *B41J 2/32* (2013.01); *B41J 11/04* (2013.01); *B41J 15/04* (2013.01); *B41J 29/00* (2013.01)

(58) Field of Classification Search
None
See application file for complete search history.

(56) References Cited

U.S. PATENT DOCUMENTS 6,414,704 B1 7/2002 Yamashita
6,447,187 B1 9/2002 Robinson
(Continued)

FOREIGN PATENT DOCUMENTS

EP 0775585 5/1997
EP 1652682 5/2006
(Continued)

OTHER PUBLICATIONS

IP.com search.*
(Continued)

*Primary Examiner* — Lisa Solomon
(74) *Attorney, Agent, or Firm* — IPUSA, PLLC

(57) ABSTRACT

A printer includes a recording head; a platen roller; a first case to which the recording head is attached, the first case including a paper-feed port for feeding recording paper; a second case to which the platen roller is attached, the second case including a paper-ejection port for ejecting the recording paper; and a lock lever that is disposed in the first case and includes a support configured to rotatably support a shaft of the platen roller. The printer is configured such that the shaft of the platen roller is placed in the support when the first case and the second case are joined together.

9 Claims, 33 Drawing Sheets

(51) Int. Cl.

| | |
|---|---|
| ***B41J 15/04*** | (2006.01) |
| ***B41J 29/00*** | (2006.01) |
| ***B41J 2/32*** | (2006.01) |

(56) References Cited

U.S. PATENT DOCUMENTS

| | | | |
|---|---|---|---|
| 6,899,479 | B2 | 5/2005 | Hayashi et al. |
| 9,586,422 | B2 | 3/2017 | Tsuchiya et al. |
| 2005/0281606 | A1 | 12/2005 | Koyama et al. |
| 2009/0086005 | A1 | 4/2009 | Ito |
| 2010/0054839 | A1 | 3/2010 | Sakai |
| 2012/0026265 | A1 | 2/2012 | Kawashima |

FOREIGN PATENT DOCUMENTS

| | | |
|---|---|---|
| EP | 1900538 | 3/2008 |
| EP | 2765005 | 8/2014 |
| JP | H03-172267 | 7/1991 |
| JP | H06-127051 | 5/1994 |
| JP | 2002-067435 | 3/2002 |
| JP | 2004-098625 | 4/2004 |
| JP | 2008-094009 | 4/2008 |
| JP | 2009-078524 | 4/2009 |
| JP | 2009-096595 | 5/2009 |
| JP | 2010-047392 | 3/2010 |
| JP | 2012-030441 | 2/2012 |
| JP | 2013-010269 | 1/2013 |

OTHER PUBLICATIONS

Machine Translation of JP 2008-094009A, Kasugai, Atsushi et al., "Printing apparatus e.g. tape printing appratus has a press spring . . . ", Apr. 24, 2008, Brother Kogyo (assignee), Paragraphs 0049-0051.*

* cited by examiner

PRINTER

TECHNICAL FIELD

An aspect of this disclosure relates to a printer.

BACKGROUND ART

Printers for issuing receipts are widely used, for example, for cash registers in stores and automated teller machines (ATM) in banks. In such a printer, information is printed on recording paper by a print head while the recording paper is being fed, and the recording paper is cut by a cutter. A paper roll is used as the recording paper for this type of printer.

RELATED-ART DOCUMENTS

Patent Documents

[Patent Document 1] Japanese Laid-Open Patent Publication No. 2013-010269

[Patent Document 2] Japanese Laid-Open Patent Publication No. 2009-096595

SUMMARY OF INVENTION

Technical Problem

A printer includes structures for holding a paper roll, such as a paper-feed shaft for supporting the paper roll and a recording-paper holder for housing the paper roll.

Also, a printer used as a built-in unit of a ticketing device for issuing receipts and a printer used as a stand-alone device have different purposes, are used in different environments, and have different design concepts, and therefore have different configurations. However, if a printer used as a stand-alone device can also be used as a built-in unit, it is possible to use the same components for them and provide printers with low costs.

Solution to Problem

In an aspect of this disclosure, there is provided a printer that includes a recording head; a platen roller; a first case to which the recording head is attached, the first case including a paper-feed port for feeding recording paper; a second case to which the platen roller is attached, the second case including a paper-ejection port for ejecting the recording paper; and a lock lever that is disposed in the first case and includes a support configured to rotatably support a shaft of the platen roller. The printer is configured such that the shaft of the platen roller is placed in the support when the first case and the second case are joined together.

Advantageous Effects of Invention

An aspect of this disclosure makes it possible to provide a printer that can be used both as a stand-alone device and as a built-in unit of a device.

DESCRIPTION OF EMBODIMENTS

Embodiments of the present invention are described below. The same reference number is assigned to the same component, and repeated descriptions of the same component are omitted.

Figure 1:
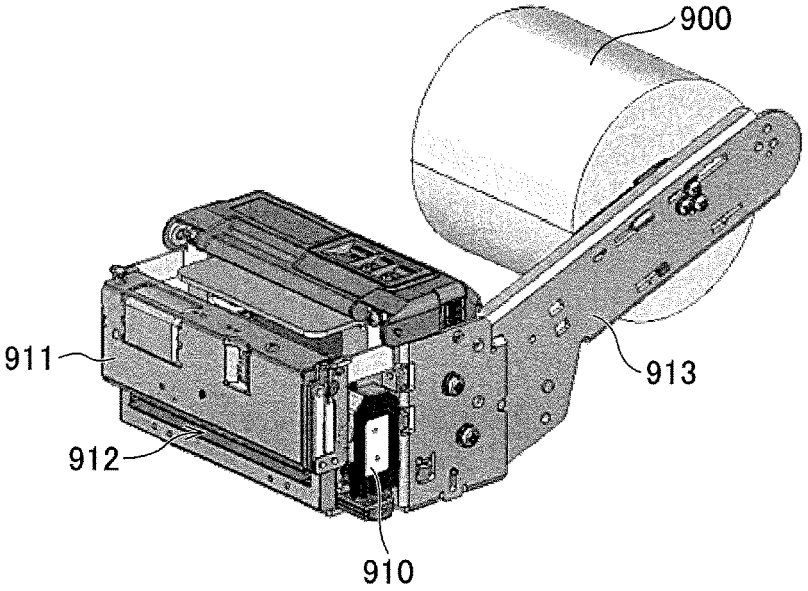
FIG. 1 is a perspective view of a printer including a paper-feed shaft.
Figure 2:
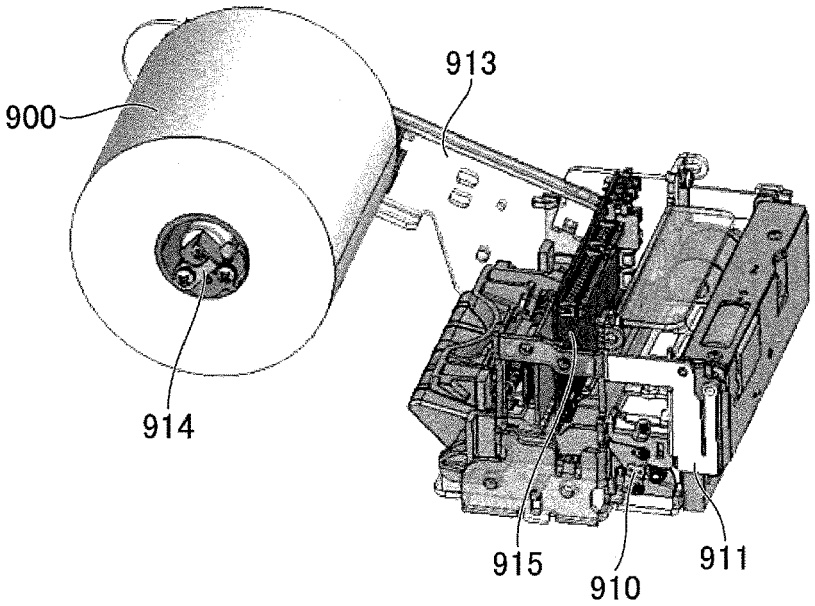
FIG. 2 is an internal perspective view of a printer including a paper-feed shaft.

A printer including a paper-feed shaft for supporting rolled recording paper (which is hereafter also referred to as a "paper roll") is described with reference to FIGS. 1 and 2. The printer includes a printing unit 910 for printing information on recording paper and a cutter 911 for cutting the recording paper. The recording paper cut by the cutter 911 is ejected from a paper ejection port 912. A paper roll 900 is installed by passing a paper-feed shaft 914 connected to an arm 913 through an opening in the center of the paper roll 900. The printer also includes a control board 915 for controlling the printer. FIG. 1 is a perspective view and FIG. 2 is an internal perspective view of the printer.

Figure 3:
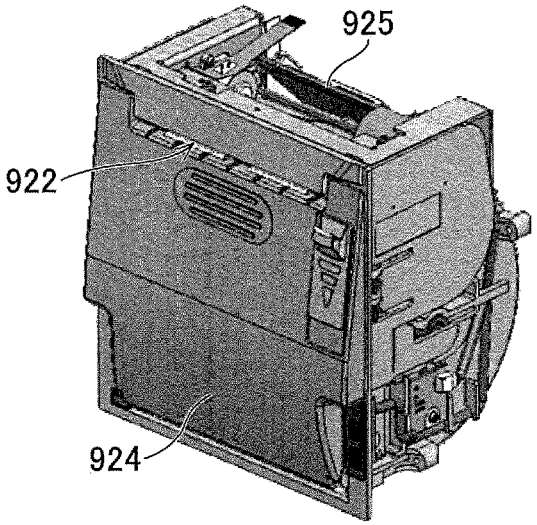
FIG. 3 is a perspective view of a printer including a recording-paper holder for housing recording paper.
Figure 4:
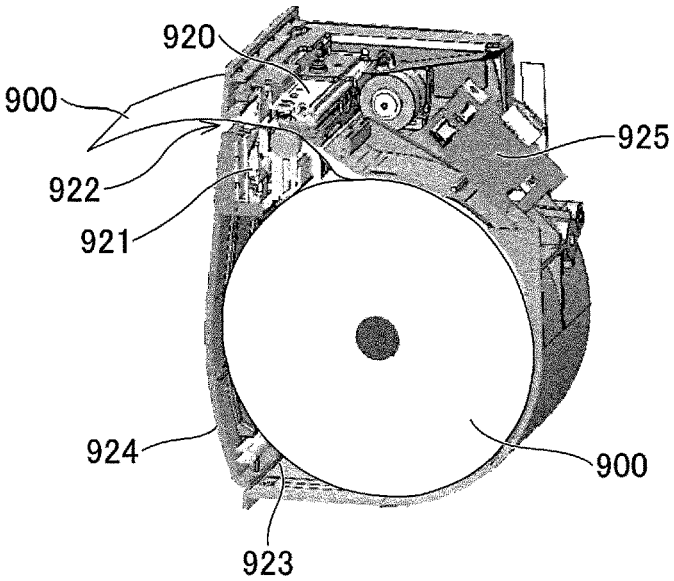
FIG. 4 is an internal perspective view of a printer including a recording-paper holder for housing recording paper.

Next, a printer including a recording-paper holder for housing a paper roll is described with reference to FIGS. 3 and 4. The printer includes a printing unit 920 and a cutter 921. Recording paper cut by the cutter 921 is ejected from a paper ejection port 922. A paper roll 900 is placed in a recording-paper holder 923 of the printer. The printer also includes a control board 925 for controlling the printer. FIG. 3 is a perspective view and FIG. 4 is an internal perspective view of the printer.

The printers illustrated by FIGS. 1 through 4 cannot be used as built-in units of devices such as ticketing devices without drastically changing their designs.

First Embodiment

<Printer>

Figure 5:
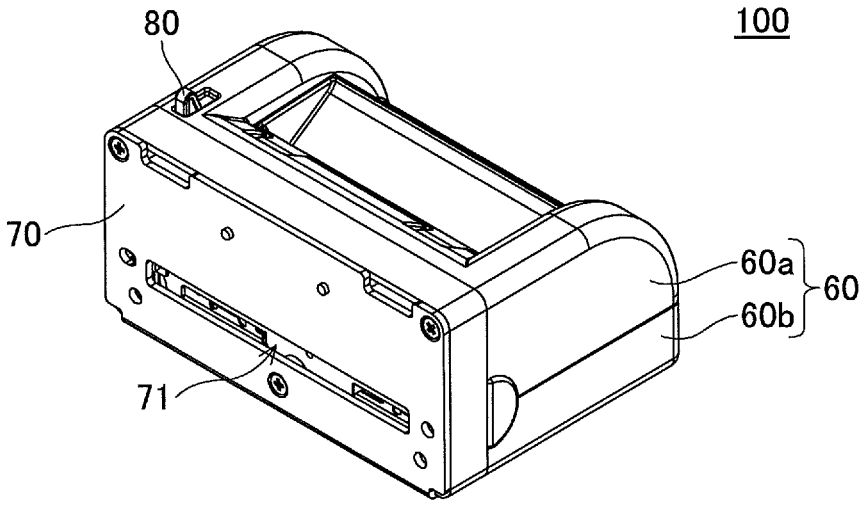
FIG. 5 is a perspective view of a printer of a first embodiment.
Figure 6:
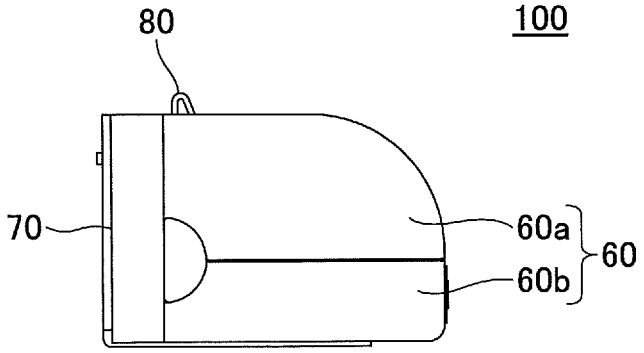
FIG. 6 is a side view of a printer of the first embodiment.
Figure 7:
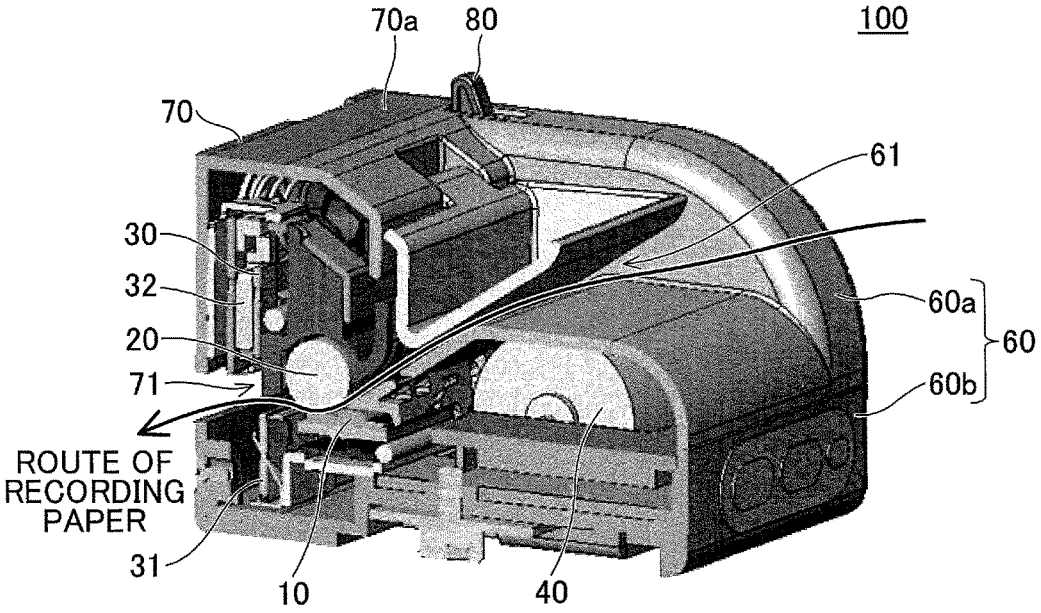
FIG. 7 is a cross-sectional perspective view of a printer of the first embodiment.
Figure 8:
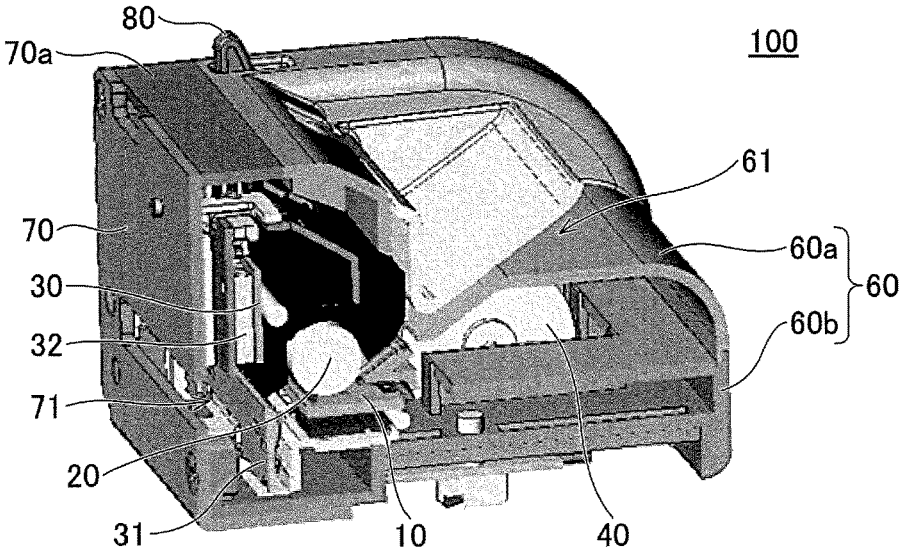
FIG. 8 is a cross-sectional perspective view of a printer of the first embodiment.
Figure 9:
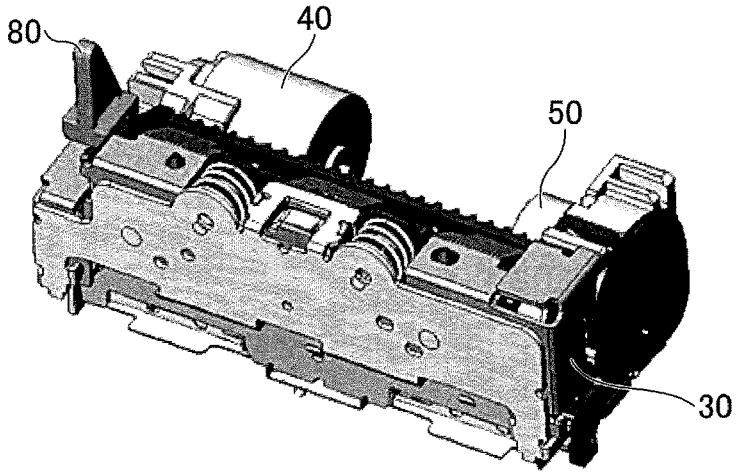
FIG. 9 is a perspective view of a printing mechanism of a printer of the first embodiment.
Figure 10:
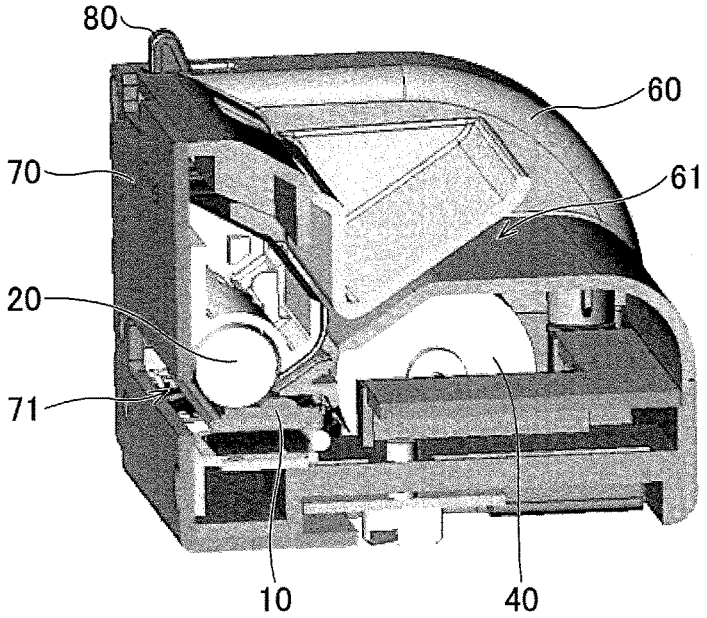
FIG. 10 is a cross-sectional perspective view of a cutter-less printer of the first embodiment.
Figure 11:
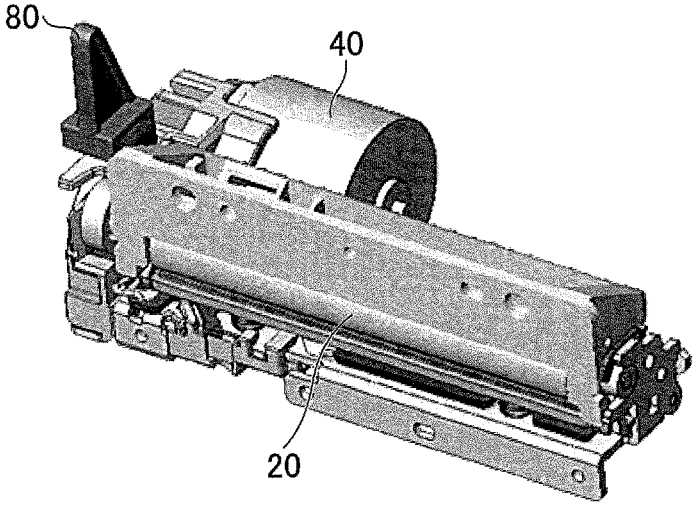
FIG. 11 is a perspective view of a cutter-less printing mechanism of the first embodiment.
Figure 12:
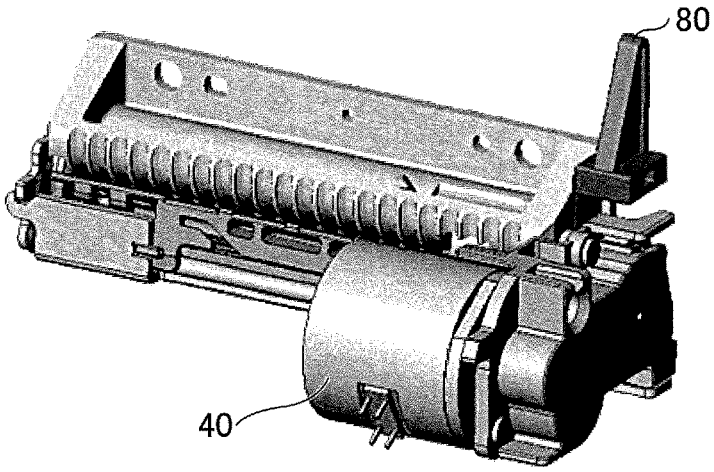
FIG. 12 is a perspective view of a cutter-less printing mechanism of the first embodiment.

Next, a printer 100 of a first embodiment is described with reference to FIGS. 5 through 12. FIG. 5 is a perspective view, FIG. 6 is a side view, and FIGS. 7 and 8 are cross-sectional perspective views of the printer 100 to which a cutter 30 is attached. FIG. 9 is a perspective view of a printing mechanism provided in the printer 100. FIG. 10 is a perspective view of the printer 100 to which the cutter 30 is not attached. FIGS. 11 and 12 are perspective views of a printing mechanism to which the cutter 30 is not attached.

The printer 100 is formed by joining a block (head module) including a thermal head 10 that is a recording head and a block (cutter module) including a platen roller 20 and the cutter 30. In FIG. 9, the head module and the cutter module are joined together, the cutter module is disposed in the front side, and the head module is disposed in the rear side.

The thermal head 10, a feeding motor 40, and a cutter motor 50 constitute the head module that is housed in a first case 60. The platen roller 20 is driven by the feeding motor 40. The platen roller 20 and the cutter 30 constitute the cutter module that is attached to a second case 70. The cutter 30 includes a fixed blade 31 and a movable blade 32 that is moved by the cutter motor 50 in a vertical direction in the figures.

The first case 60 includes an upper case 60*a* and a lower case 60*b* that can be separated from each other. In the present embodiment, the first case 60 is formed of a resin, and the second case 70 is formed of a sheet metal. However, the first case 60 and the second case 70 may also be formed of other materials.

Recording paper 200 (see FIG. 15) is inserted through a paper-feed port 61 of the first case 60 into the printer 100, passes through a gap between the thermal head 10 and the platen roller 20 where information is printed on the recording paper 200, and is ejected from a paper-ejection port 71 formed in the second case 70.

The printer 100 can be configured as a cutter-equipped printer as illustrated in FIGS. 5 through 9 by providing the cutter module in the second case 70. Also, the printer 100 can be configured as a cutter-less printer as illustrated in FIGS. 10 through 12 by attaching a platen module, instead of the cutter module, to the second case 70. The platen module includes the platen roller 20 but does not include the cutter 30. The same printer can be configured either as a cutter-equipped printer or a cutter-less printer by attaching one of the cutter module and the platen module to the second case 70.

FIGS. 11 and 12 illustrate a printing mechanism formed by combining the platen module and the head module. The platen module is disposed in the front side in FIG. 11 (the rear side in FIG. 12), and the head module is disposed in the font side in FIG. 12 (the rear side in FIG. 11). Because the cutter 30 is not provided in the platen module, the cutter motor 50 is not provided in the head module nor the platen module.

Hereafter, when it is not necessary to distinguish between the cutter module and the platen module, both of the cutter module and the platen module may be referred to as the "cutter module".

In the cutter-equipped printer, a frame part 70*a* is provided between the first case 60 and the second case 70. In contrast, the frame part 70*a* is not provided in the cutter-less printer. The frame part 70*a* has a width that corresponds to the difference in size (thickness) between the cutter module and the platen module, and is used to adjust the length of the case to the cutter-equipped or cutter-less printer. In the illustrated examples, the configuration of the second case 70 is changed to suit each one of the cutter-equipped and cutter-less printers. However, the second case 70 with the same configuration may be used for both types of printers.

Figure 13:
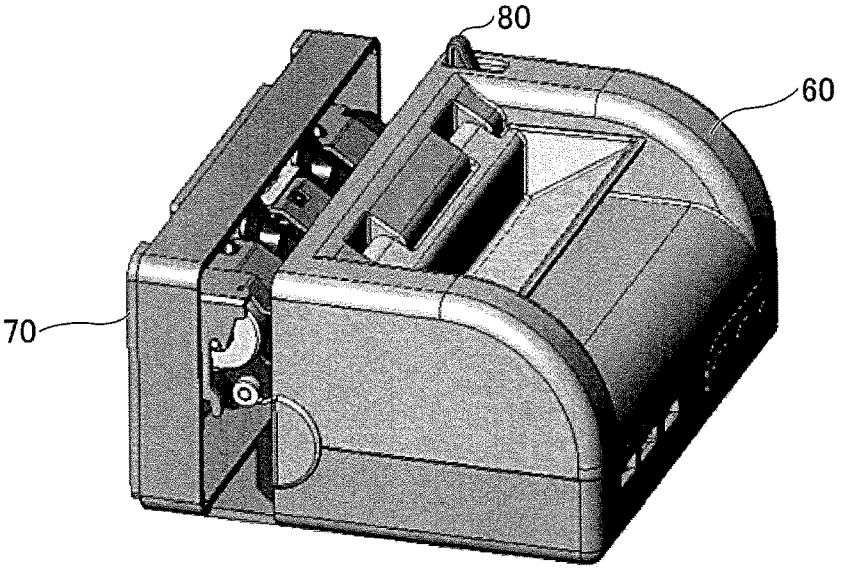
FIG. 13 is a drawing illustrating a state where a first case and a second case are separated from each other.
Figure 14:
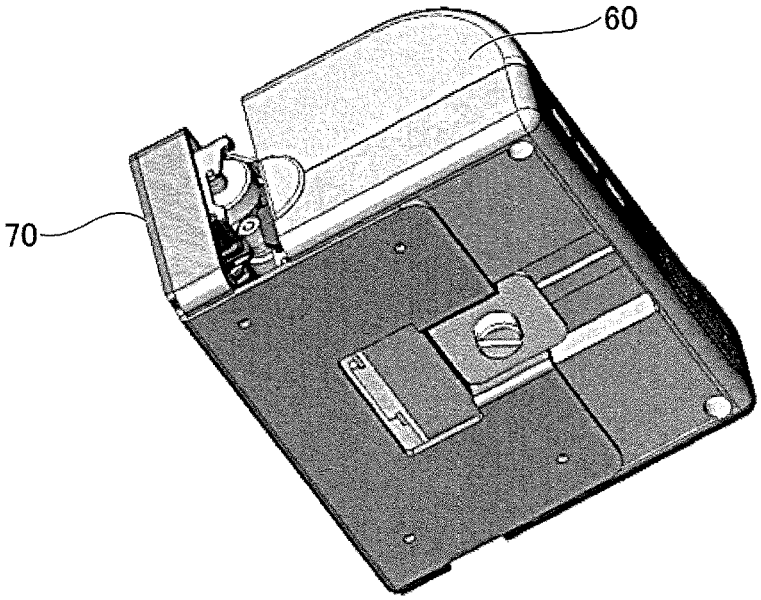
FIG. 14 is a drawing illustrating a state where a first case and a second case are separated from each other.

As illustrated in FIGS. 5 and 7, the printer 100 can print information on the recording paper 200 in a state where the first case 60 and the second case 70 are joined together. By moving an opening knob 80 in this state, the first case 60 can be separated from the second case 70 as illustrated in FIGS. 13 and 14. Separating the first case 60 and the second case 70 makes it easier to remove recording paper jammed in the printer 100.

Figure 15:
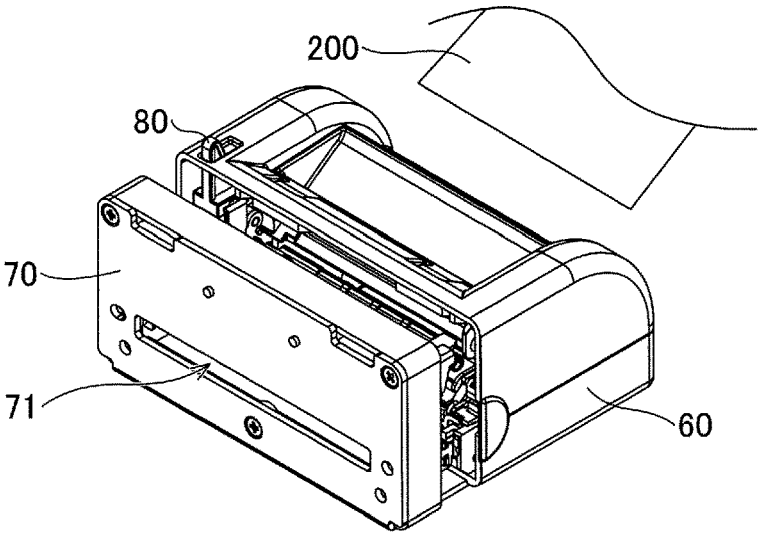
FIG. 15 is a drawing illustrating how to remove recording paper from a printer.
Figure 16:
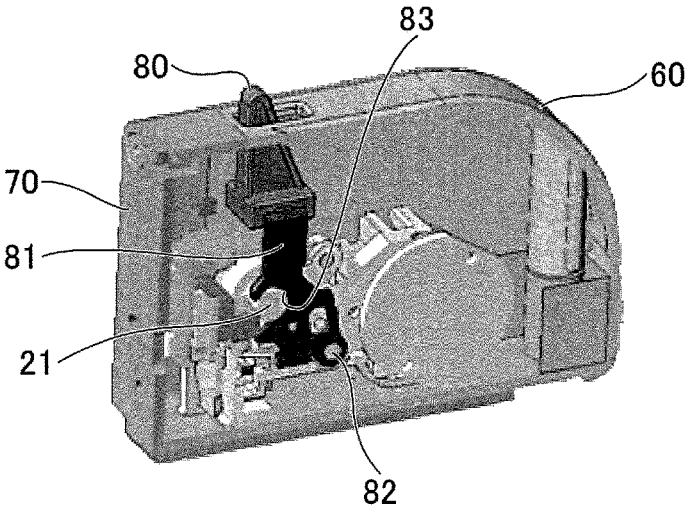
FIG. 16 is a drawing illustrating a lock lever.
Figure 17:
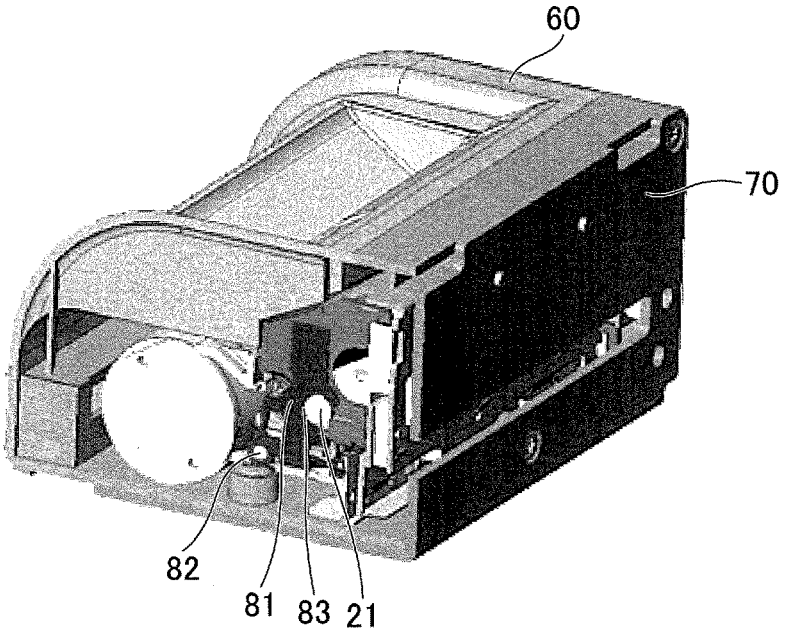
FIG. 17 is a drawing illustrating a lock lever.
Figure 18:
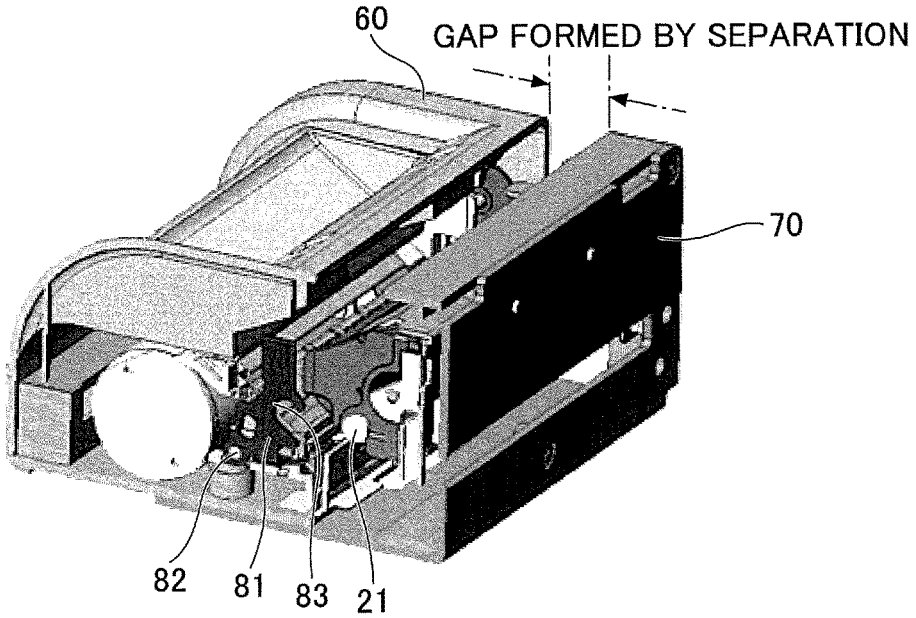
FIG. 18 is a drawing illustrating a lock lever.

When the recording paper 200 is jammed, the opening knob 80 is moved to move and separate the first case 60 from the second case 70, and the recording paper 200 is removed as illustrated in FIG. 15. As illustrated in FIGS. 16 through 18, the opening knob 80 is connected to a lock lever 81 that rotates about a rotational shaft 82, and a shaft 21 of the platen roller 20 is rotatably supported by a support 83 of the lock lever 81. The head module and the cutter module are joined together in a state where the shaft 21 of the platen roller 20 is supported by the support 83. FIGS. 16 and 17 are cross-sectional perspective views of the printer 100 in a state where the first case 60 and the second case 70 are joined together, and the shaft 21 is supported by the support 83. FIG. 18 is a cross-sectional perspective view of the printer 100 in a state where the first case 60 and the second case 70 are separated from each other, and the shaft 21 is disengaged from the support 83. When the first case 60 is separated from the second case 70, a gap is formed between the first case 60 and the second case 70 as illustrated in FIG. 18.

Figure 19:
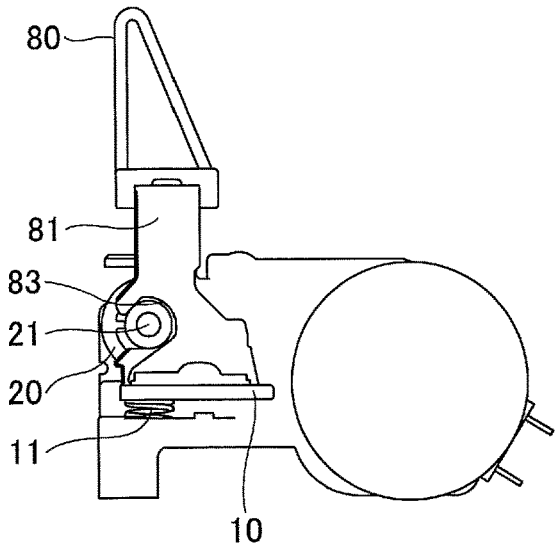
FIG. 19 is a drawing illustrating a lock lever.
Figure 20:
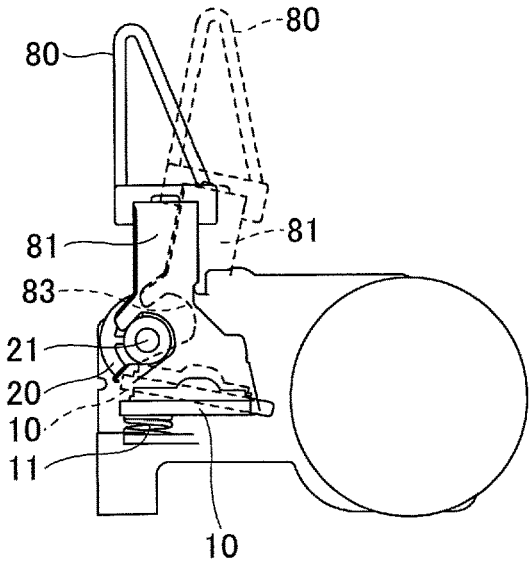
FIG. 20 is a drawing illustrating a lock lever.
Figure 21:
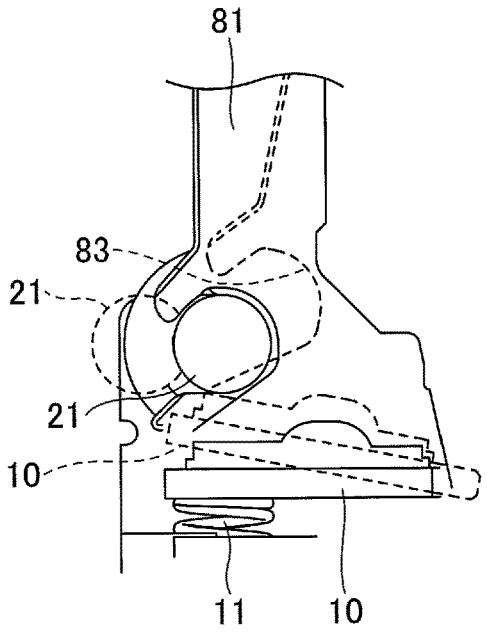
FIG. 21 is a drawing illustrating a lock lever.

FIGS. 19 through 21 are drawings illustrating how relevant components work when the opening knob 80 is operated. FIG. 19 illustrates a state where the shaft 21 of the platen roller 20 is supported by the support 83. Dotted lines in FIGS. 20 and 21 illustrate a state where the support 83 is disengaged from the shaft 21 as a result of moving the opening knob 80.

In the state of FIG. 19 where the cutter module and the head module are joined together, the back side of the thermal head 10 is biased upward in the illustration by a spring 11, and the thermal head 10 is in contact with the platen roller 20.

Figure 22:
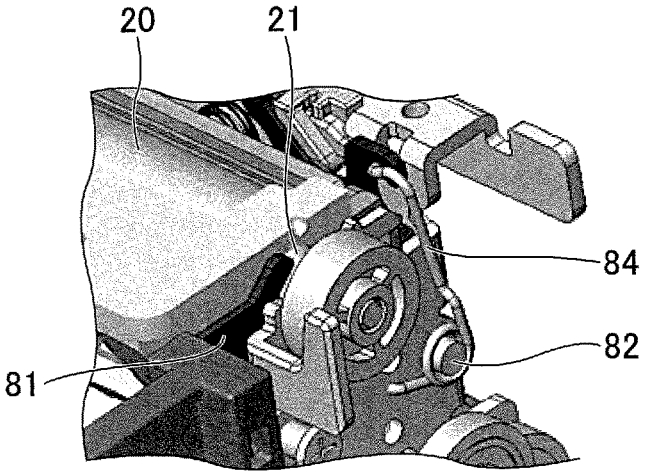
FIG. 22 is a drawing illustrating a lock lever.

As illustrated in FIG. 20, when the opening knob 80 is moved, the lock lever 81 rotates about the rotational shaft 82 and moves to the right in FIG. 20. As a result, the support 83 is disengaged from the shaft 21 of the platen roller 20, and the head module and the cutter module are disengaged from each other. When the shaft 21 is released from the support 83, the thermal head 10 moves upward due to the biasing force of the spring 11, and the platen roller 20 is biased upward. However, because the cutter module including the platen roller 20 is fixed to the second case 70, the upward movement of the platen roller 20 is restricted, and the platen roller 20 is biased to the left as indicated by a dotted line in FIG. 21. Because the platen module and the head module are disengaged from each other, the second case 70 is caused by the leftward biasing force to move to the left relative to the first case 60, and the first case 60 and the second case 70 are separated from each other. As illustrated in FIG. 22, a torsion spring 84 is connected to the lock lever 81. The torsion spring 84 biases the lock lever 81 to return to a position where the support 83 supports the shaft 21. An end of the torsion spring 84 is fixed to the frame of the head module, and another end of the torsion spring 84 engages with the lock lever 81.

Figure 23:
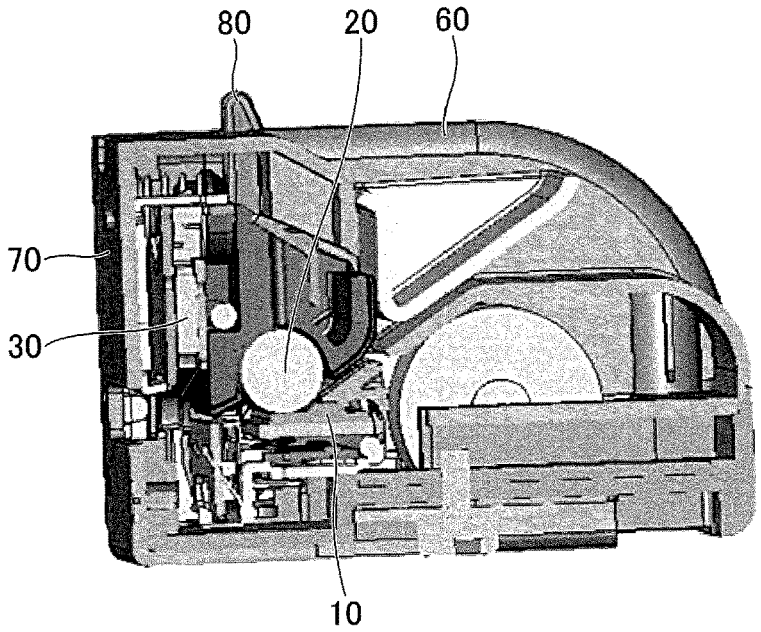
FIG. 23 is a cross-sectional view of a printer of the first embodiment.
Figure 24:
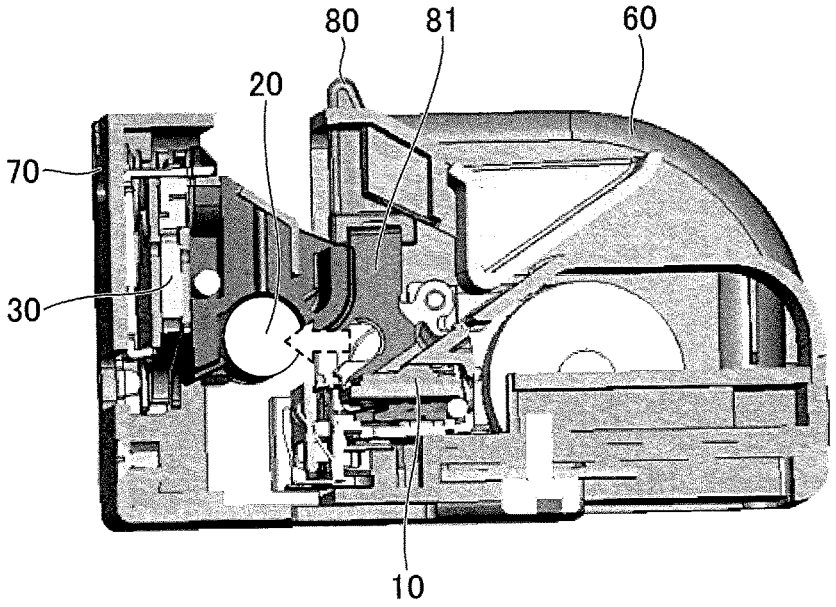
FIG. 24 is a cross-sectional view of a printer of the first embodiment.

FIG. 23 is a cross-sectional view of the printer 100 in a state where the first case 60 and the second case 70 are joined together. FIG. 24 is a cross-sectional view of the printer 100 in a state where the first case 60 and the second case 70 are separated from each other by moving the opening knob 80. In the state of FIG. 23, the head module and the cutter module are joined together, and the platen roller 20 is pressed against the thermal head 10. When the opening knob 80 is moved in the state of FIG. 23, the second case 70 slides to the left and is separated from the first case 60 as illustrated in FIG. 24, and the cutter module and the head module become detachable from each other. Also, as illustrated in FIG. 24, when the second case 70 moves away from the first case 60 in the direction indicated by an arrow, the platen roller 20 is brought out of contact with the thermal head 10 and a gap is formed between the platen roller 20 and the thermal head 10. As a result, a path for feeding the recording paper 200 is opened, and jammed recording paper can be easily removed.

Figure 25:
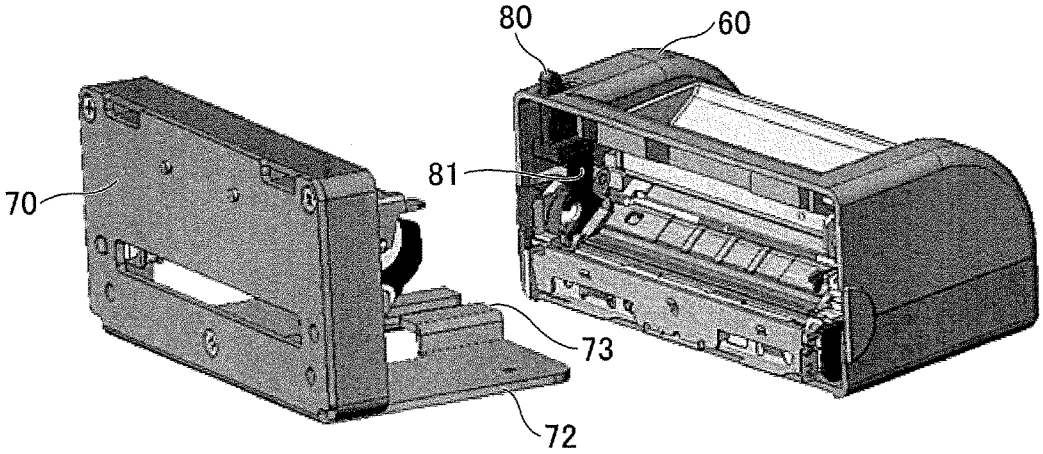
FIG. 25 is a perspective view of a printer of the first embodiment.
Figure 26:
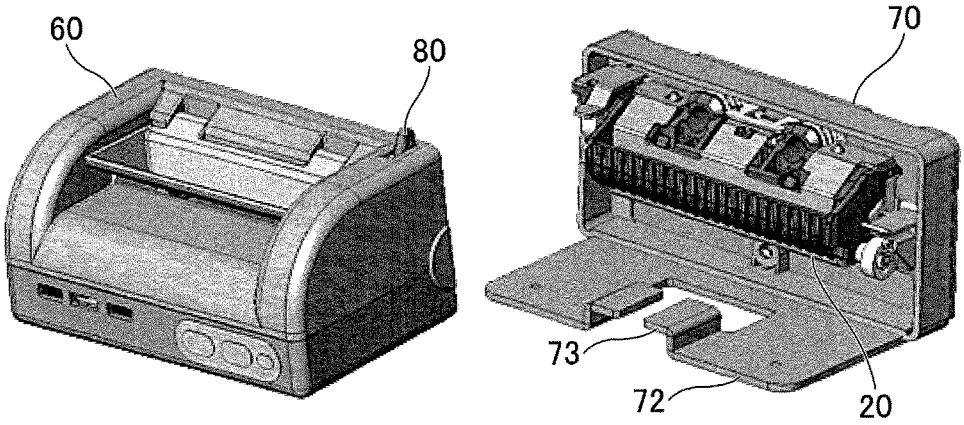
FIG. 26 is a perspective view of a printer of the first embodiment.

FIGS. 25 and 26 are perspective views of the printer 100 in a state where the first case 60 and the second case 70 are separated from each other. A pair of sliding parts 73 are provided in the middle of a bottom surface 72 of the second case 70. Each of the sliding parts 73 includes a vertical portion extending upward and a horizontal portion extending horizontally from an end of the vertical portion, and has an L-shape. Also, as illustrated in FIGS. 27, 28, 30, and 31, a groove 63 is formed in the middle of a bottom surface 62 of the first case 60. The groove 63 extends in a direction in which the first case 60 moves relative to the second case 70. A screw hole is formed in the groove 63, and the width of the groove 63 is substantially the same as the distance between the horizontal portions of two sliding parts 73. The first case 60 includes a support 64 in which a hole for inserting a screw 65 is formed.

To attach the first case 60 to the second case 70, the sliding parts 73 are placed in the groove 63, the support 64 is placed on the lower surfaces of the sliding parts 73, and the screw 65 is passed through the hole in the support 64 and screwed into the screw hole formed in the groove 63. A gap is provided between the horizontal portions of the two sliding parts 73 so that the sliding parts 73 can slide in the groove 63 without interfering with the screw 65.

With the configuration where the sliding parts 73 slide in the groove 63 formed in the bottom surface 62 of the first case 60, the first case 60 and the second case 70 can be joined together as illustrated in FIG. 23 and can be separated from each other as illustrated in FIG. 24. Thus, the sliding parts 73 are slidably supported between the groove 63 and the support 64. This configuration makes it possible to prevent the second case 70 from being completely detached from the first case 60 when the second case 70 is separated from the first case 60.

Figure 27:
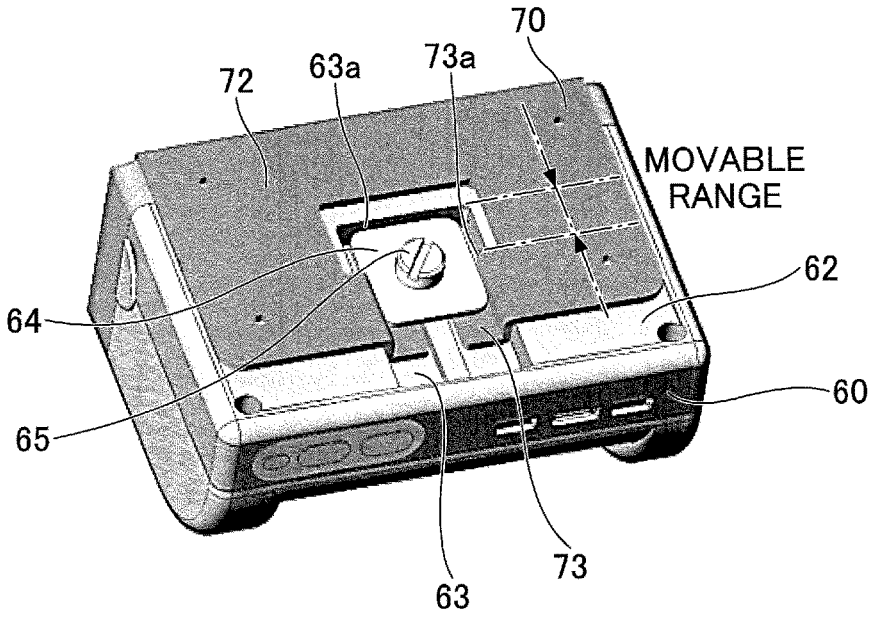
FIG. 27 is a bottom perspective view of a printer of the first embodiment.
Figure 28:
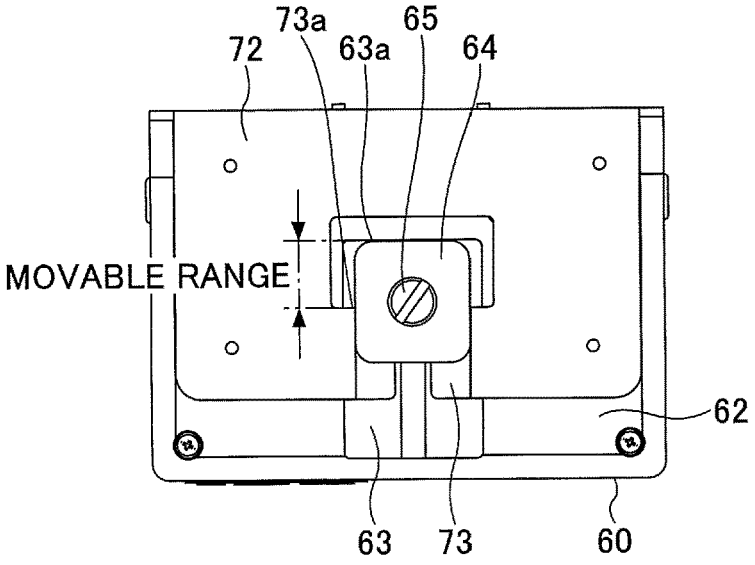
FIG. 28 is a bottom view of a printer of the first embodiment.
Figure 29:
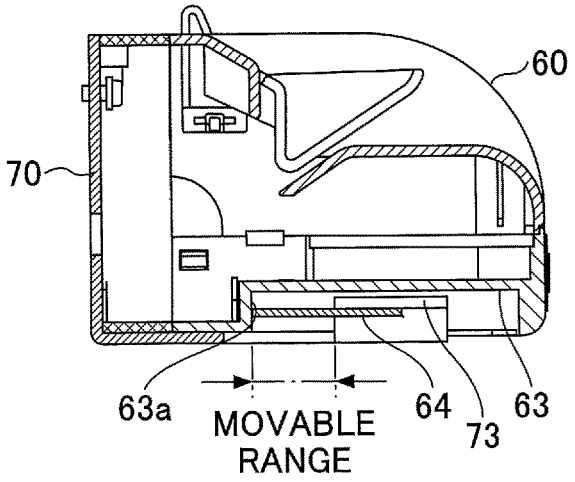
FIG. 29 is a cross-sectional view of a printer of the first embodiment.

In the present embodiment, as illustrated in FIGS. 30 through 33, the sliding movement of the first case 60 stops when ends 73*a* of the sliding parts 73 contact an end 63*a* of the groove 63 which is closer to the second case 70. In FIGS. 27 and 28, the first case 60 is closest to the second case 70. In this state, the distance between the end 63*a* and the ends 73*a* is largest. Thus, the sliding parts 73 can move between a position at which the first case and the second case 70 are joined and the end 63*a* and the ends 73*a* are furthest from each other, and a position at which the sliding parts 73 contact the end 63*a*. FIGS. 27 through 29 illustrate a movable range of the sliding parts 73. With the configuration where the ends 73*a* of the sliding parts 73 contact the end 63*a*, it is possible to limit the distance that the first case 60 can move relative to the second case 70, and prevent the first case 60 from being completely detached from the second case 70.

Figure 30:
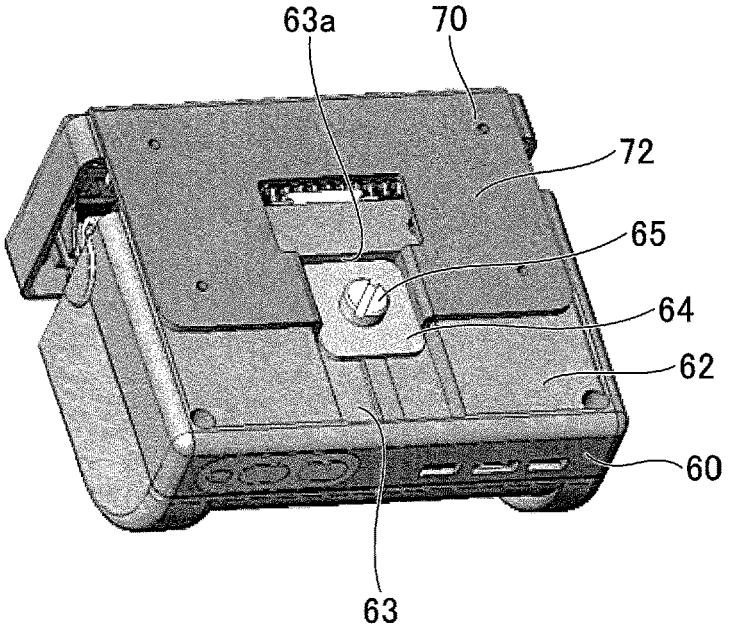
FIG. 30 is a bottom perspective view of a printer of the first embodiment.
Figure 31:
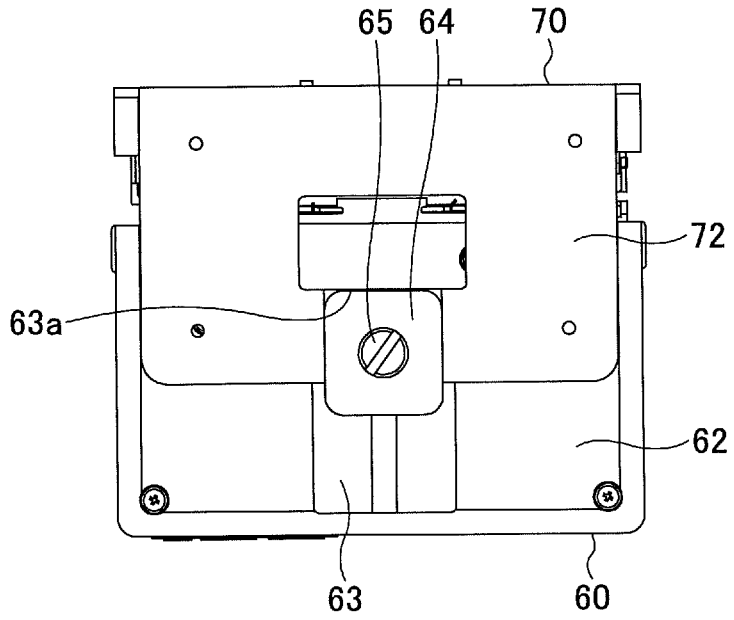
FIG. 31 is a bottom view of a printer of the first embodiment.
Figure 32:
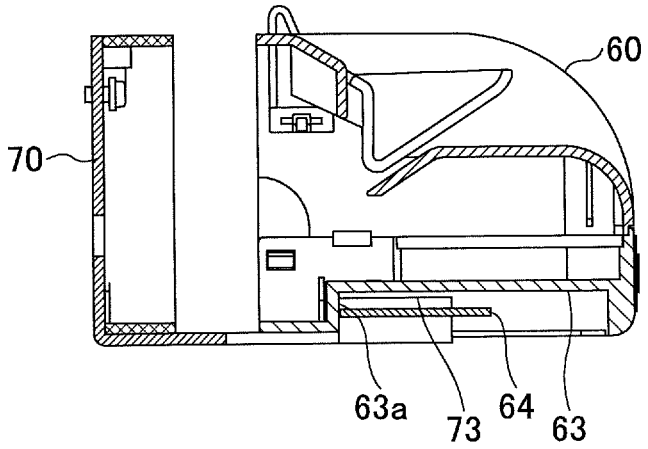
FIG. 32 is a cross-sectional view of a printer of the first embodiment.
Figure 33:
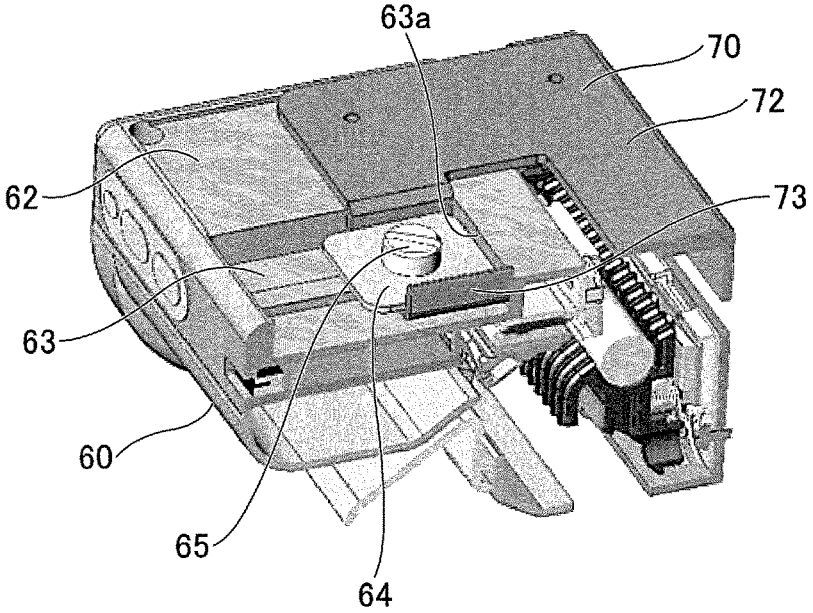
FIG. 33 is a cross-sectional perspective view of a printer of the first embodiment.

FIG. 27 is a bottom perspective view, FIG. 28 is a bottom view, and FIG. 29 is a cross-sectional view of the printer 100 in a state where the first case 60 and the second case 70 are joined together. FIG. 30 is a bottom perspective view, FIG. 31 is a bottom view, and FIG. 32 is a cross-sectional view of the printer 100 in a state where the first case 60 and the second case 70 are separated from each other. FIG. 33 is a cross-sectional perspective view of the printer 100.

Figure 34:
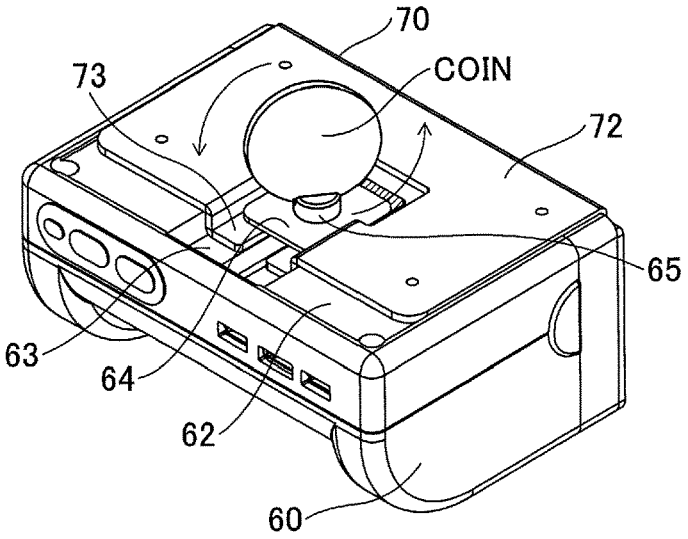
FIG. 34 is a perspective view of a printer of the first embodiment.

As illustrated in FIG. 34, the printer 100 is configured such that the first case 60 can be attached to the second case 70 by turning the screw 65 with, for example, a coin, i.e., without using a tool such as a screwdriver.

<Installation in Ticketing Device>

The printer 100 of the present embodiment can be installed, as a printer module, on a wall of another device such as a receipt issuing device ("ticketing device" is used hereafter as a generic term indicating such a device). For example, as illustrated in FIGS. 35 through 38, the printer 100 can be installed in a ticketing device by screwing a back surface 74 of the second case 70, where the paper-ejection port 71 is formed, to a wall 210 of the ticketing device. An opening 211 for ejecting the recording paper 200 is formed in the wall 210 of the ticketing device at a position corresponding to the paper-ejection port 71 of the printer 100.

Figure 35:
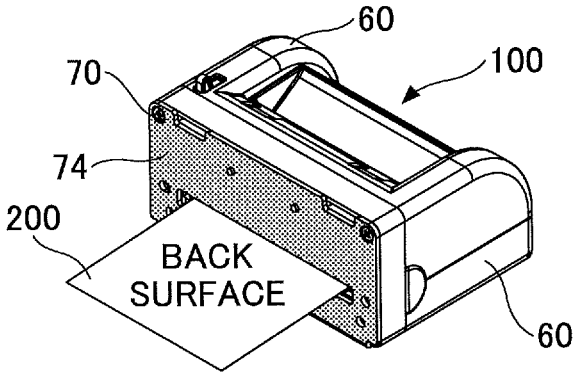
FIG. 35 is a drawing illustrating a method of attaching a printer to a ticketing device.
Figure 36:
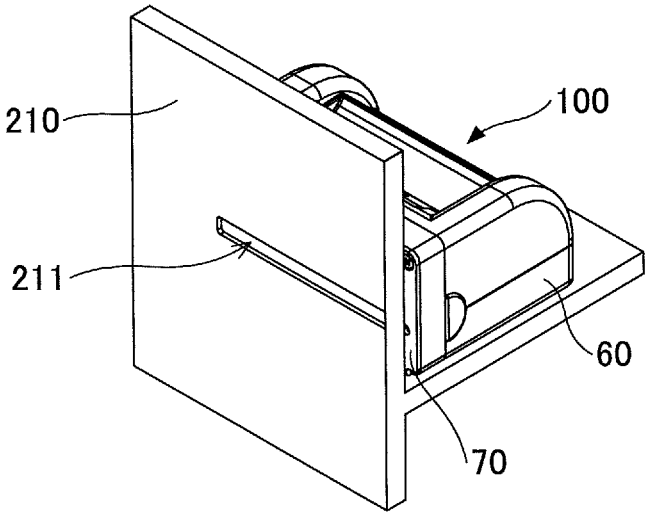
FIG. 36 is a drawing illustrating a method of attaching a printer to a ticketing device.
Figure 37:
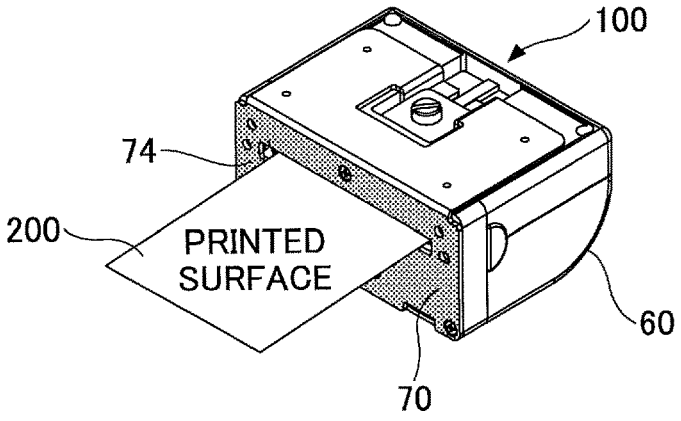
FIG. 37 is a drawing illustrating a method of attaching a printer to a ticketing device.
Figure 38:
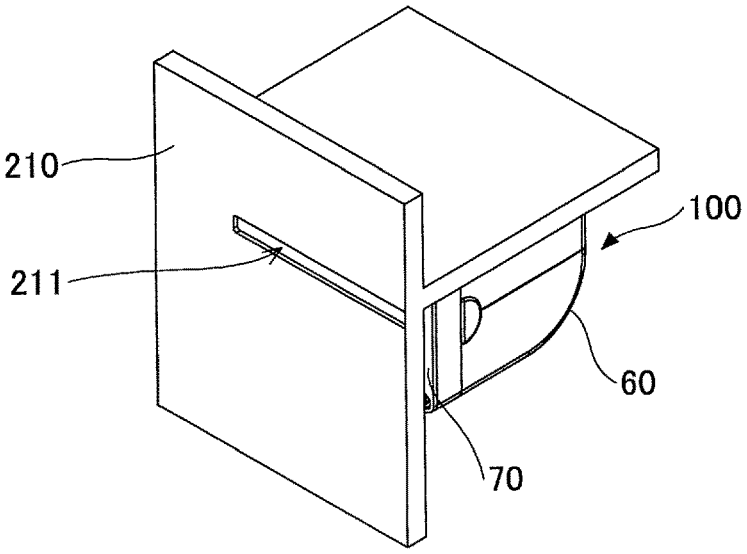
FIG. 38 is a drawing illustrating a method of attaching a printer to a ticketing device.

FIG. 35 is a perspective view of the printer 100 that is oriented such that the paper-feed port 61 faces upward. FIG. 36 is a perspective view of the printer 100 that is installed on the wall 210 of the ticketing device in the orientation illustrated in FIG. 35. In this case, the upper side of the recording paper 200 is the back surface that is opposite the printed surface, i.e., the lower side of the recording paper 200 is the printed surface. FIG. 37 is a perspective view of the printer 100 that is oriented such that the paper-feed port 61 faces downward. FIG. 38 is a perspective view of the printer 100 that is installed on the wall 210 in the orientation illustrated in FIG. 37. In the case of FIGS. 37 and 38, the upper side of the recording paper 200 is the printed surface.

Figure 39:
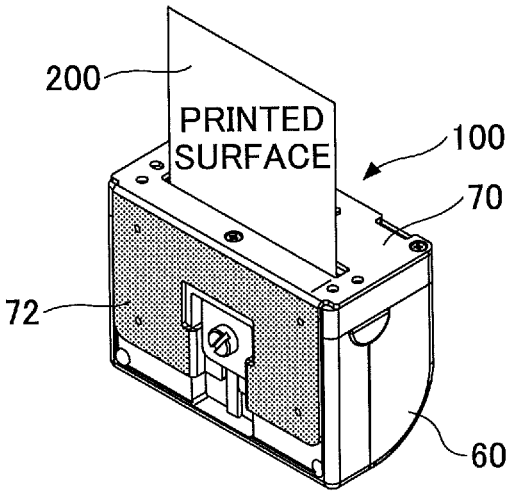
FIG. 39 is a drawing illustrating a method of attaching a printer to a ticketing device.
Figure 40:
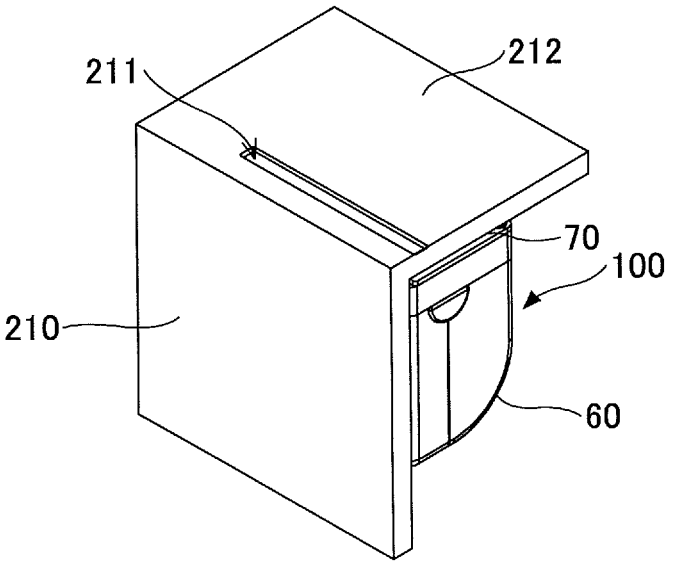
FIG. 40 is a drawing illustrating a method of attaching a printer to a ticketing device.
Figure 41:
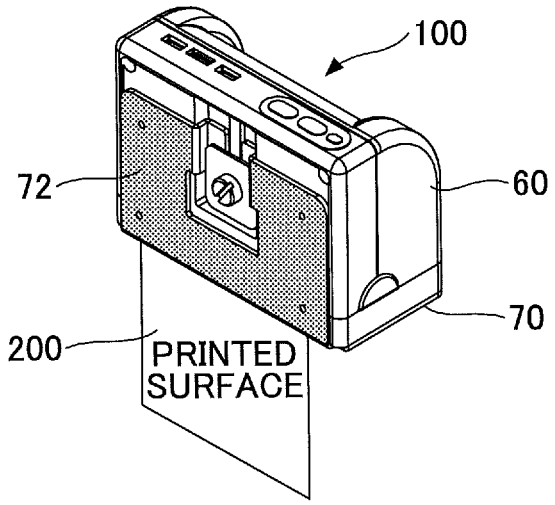
FIG. 41 is a drawing illustrating a method of attaching a printer to a ticketing device.
Figure 42:
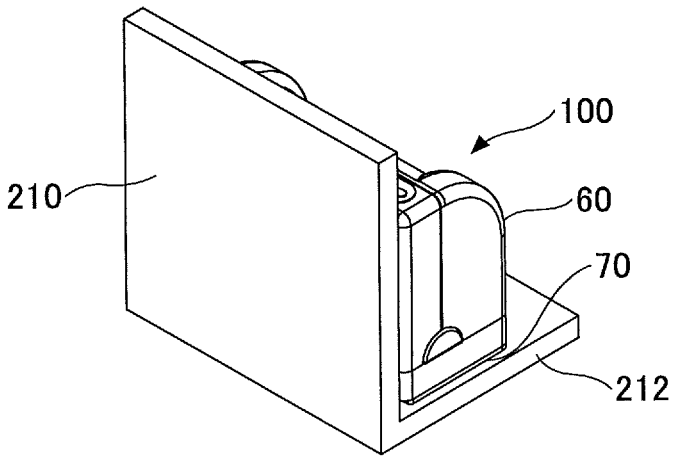
FIG. 42 is a drawing illustrating a method of attaching a printer to a ticketing device.

FIG. 39 is a perspective view of the printer 100 that is oriented such that the paper-ejection port 71 faces upward. FIG. 40 is a perspective view of the printer 100 that is installed on the wall 210 in the orientation illustrated in FIG. 39. FIG. 41 is a perspective view of the printer 100 that is oriented such that the paper-ejection port 71 faces downward. FIG. 42 is a perspective view of the printer 100 that is installed on the wall 210 in the orientation illustrated in FIG. 41. As illustrated in FIGS. 39, 40, 41, and 42, the printer 100 of the present embodiment can be installed by screwing the bottom surface 72 of the second case 70 to the wall 210 of the ticketing device. In this case, the opening 211 for ejecting the recording paper 200 is formed in a wall 212, which is perpendicular to the wall 210 on which the printer 100 is attached, at a position corresponding to the paper-ejection port 71. The recording paper 200 is ejected upward in FIGS. 39 and 40, and ejected downward in FIGS. 41 and 42.

Figure 43A:
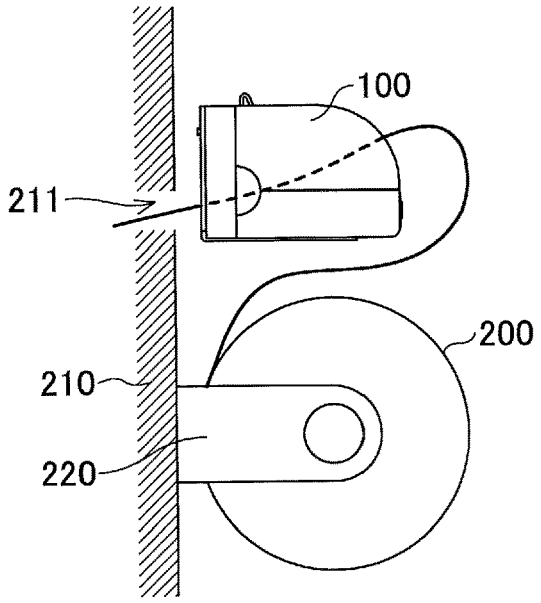
FIG. 43A is a drawing illustrating a method of attaching a printer to a ticketing device.
Figure 43B:
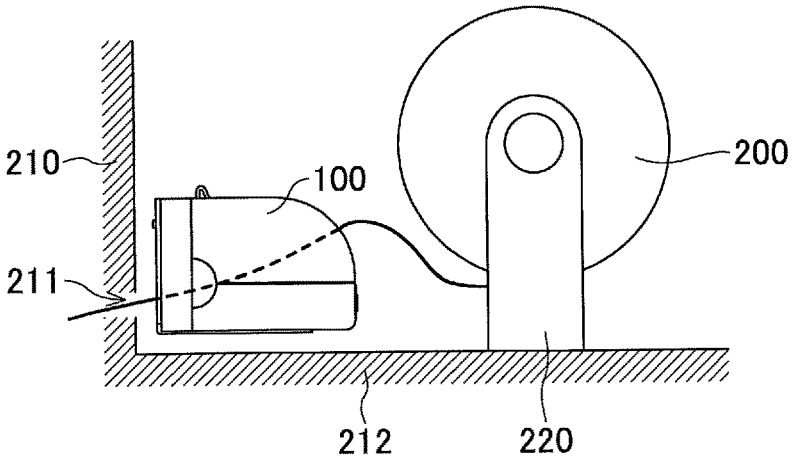
FIG. 43B is a drawing illustrating a method of attaching a printer to a ticketing device.
Figure 43C:
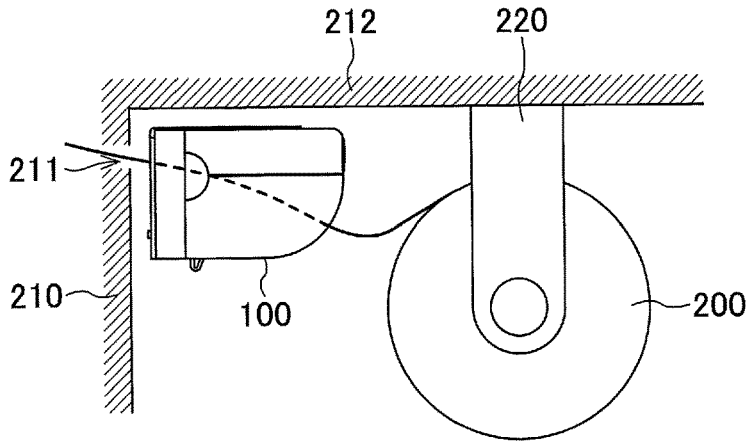
FIG. 43C is a drawing illustrating a method of attaching a printer to a ticketing device.

As illustrated in FIGS. 43A through 43C, the printer 100 and a holder 220 for holding the rolled recording paper 200 can be attached to the wall 210 and/or the wall 212.

<Cutter-Less Printer>

Figure 44:
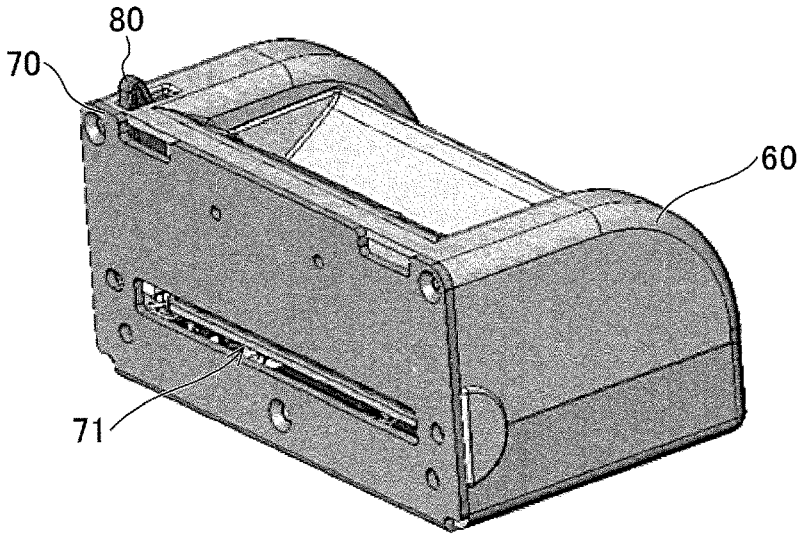
FIG. 44 is a perspective view of a cutter-less printer of the first embodiment.
Figure 45:
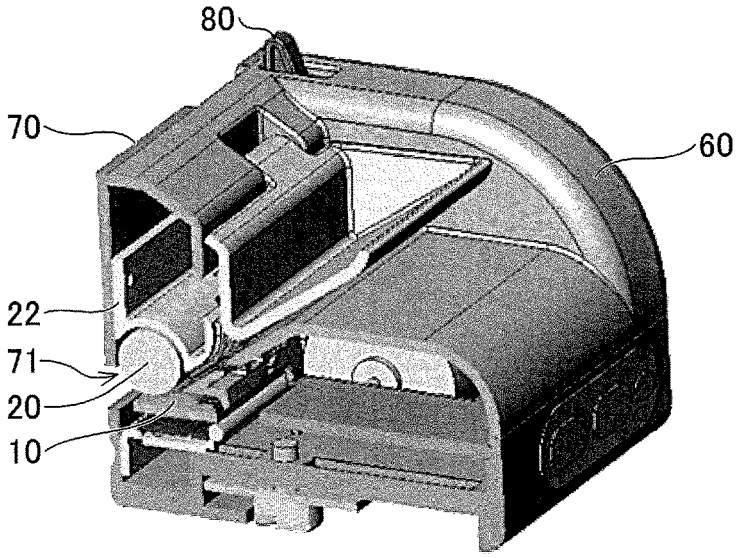
FIG. 45 is a cross-sectional perspective view of a cutter-less printer of the first embodiment.
Figure 46:
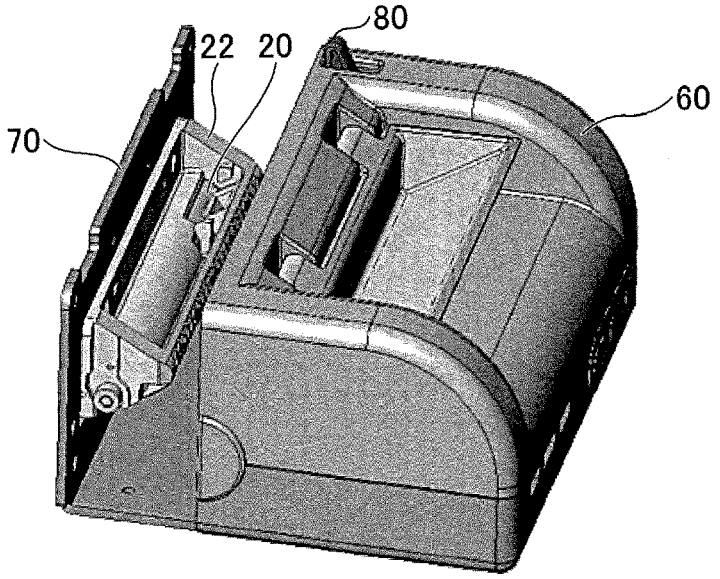
FIG. 46 is a perspective view of a cutter-less printer of the first embodiment.

Next, a cutter-less printer is described with reference to FIGS. 44 through 46. The printer 100 can be configured as a cutter-less printer by attaching, instead of the cutter module, the platen module that does not include the cutter 30 to the second case 70. In the example of FIGS. 44 through 46, a platen roller unit (platen module) 22 including the platen roller 20 is attached to the second case 70. FIG. 44 is a perspective view and FIG. 45 is a cross-sectional perspective view of the cutter-less printer in a state where the first case 60 and the second case 70 are joined together. FIG. 46 is a perspective view of the cutter-less printer in a state where the first case 60 and the second case 70 are separated from each other.

Also in the case of the cutter-less printer, the platen roller 20 can be moved away from the thermal head 10 by operating the opening knob 80 and thereby moving the first case 60 relative to the second case 70 as illustrated in FIG. 46.

<Stand-Alone Printer>

Figure 47:
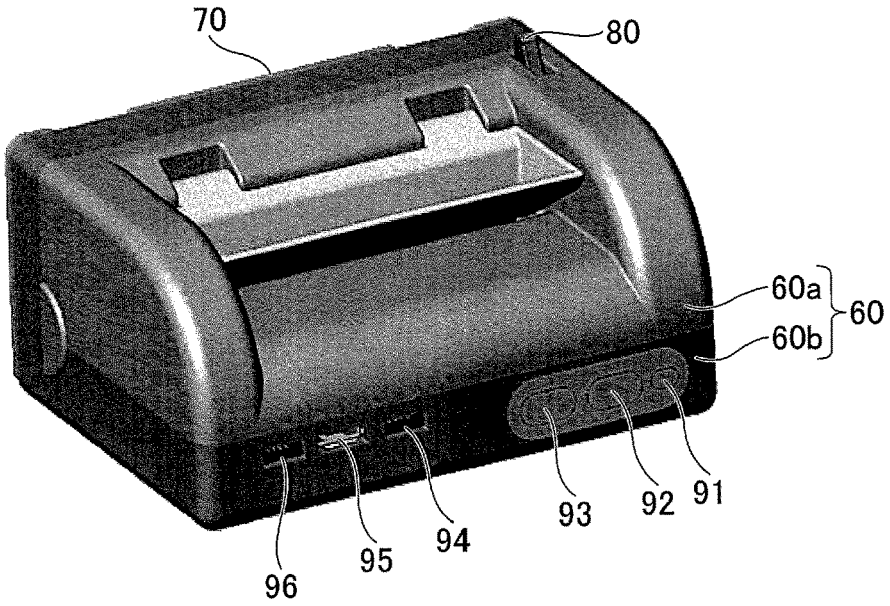
FIG. 47 is a perspective view of a stand-alone printer of the first embodiment.
Figure 48:
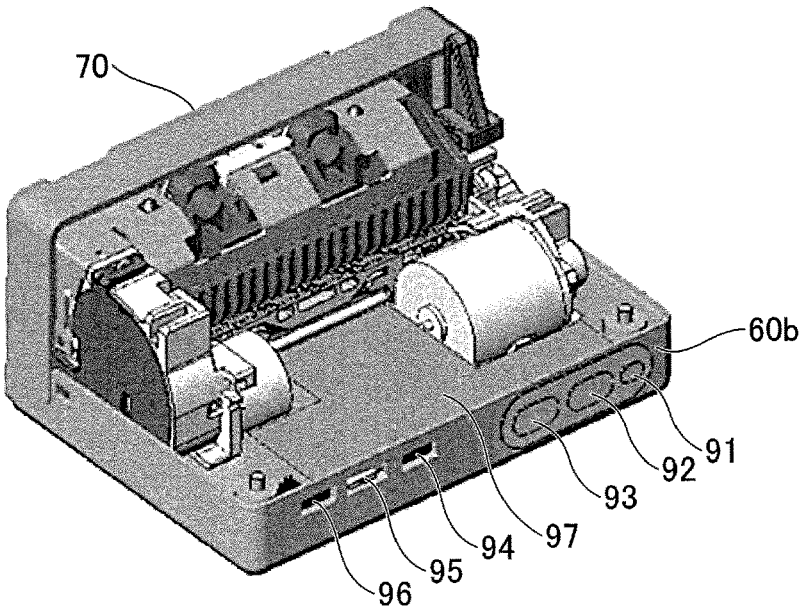
FIG. 48 is an internal perspective view of a stand-alone printer of the first embodiment.

The printer 100 of the present embodiment can be used not only as a printer unit to be installed in a ticketing device, but also as a stand-alone printer as illustrated in FIGS. 47 and 48.

In this case, for example, an operations panel for operating the printer 100 is provided on the front surface of the lower case 60*b*. In the example of FIGS. 47 and 48, a light-emitting diode (LED) 91 indicating the operational state of the printer 100, a cut key 92 operated to cut the recording paper 200, a feed key 93 operated to feed the recording paper 200, an RS232C terminal 94 that is an interface, a universal serial bus (USB) terminal 95, and an AC adaptor terminal 96 for power supply are provided on the front surface of the lower case 60*b*. Also, as illustrated in FIG. 48, a control board 97 is provided in the first case 60 to enable the printer 100 to function as a stand-alone device. The components illustrated in FIGS. 47 and 48 are examples. Some of those components may be omitted, and other components may be added to the printer 100.

Figure 49:
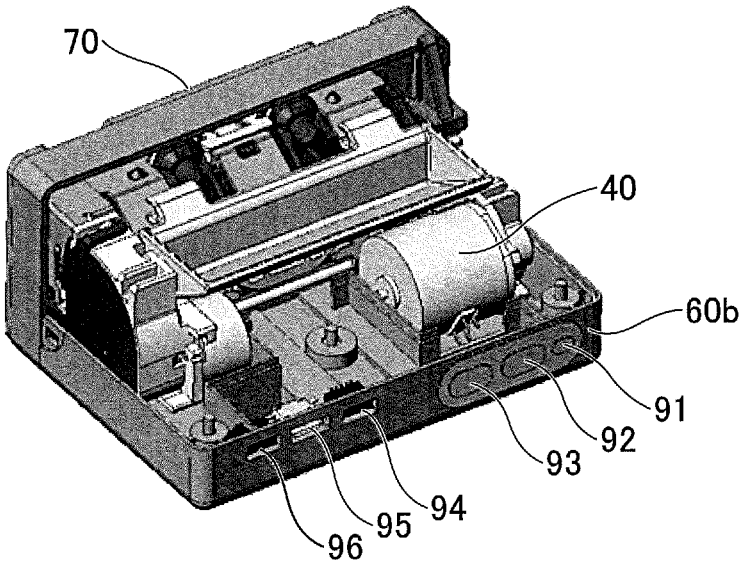
FIG. 49 is an internal perspective view of a printer including no control board.

When the printer 100 is installed in a ticketing device as a module, the printer 100 may be configured to include the control board 97 or to include no control board as illustrated in FIG. 49. In the latter case, the printer 100 may be controlled by, for example, a controller of the ticketing device.

<Paper-Ejection Port>

Figure 50:
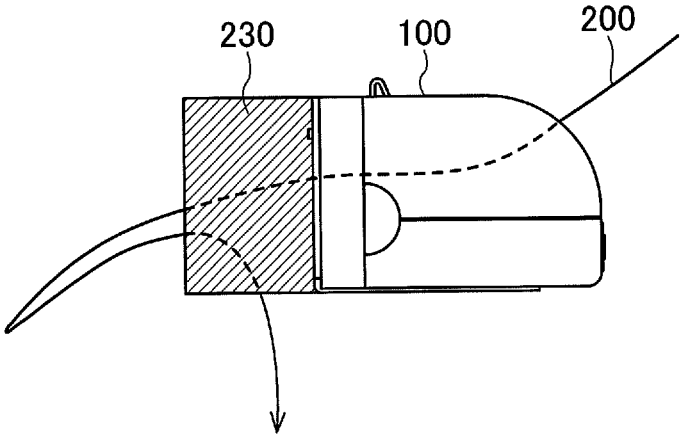
FIG. 50 is a drawing illustrating a printer to which a presenter is connected.
Figure 51:
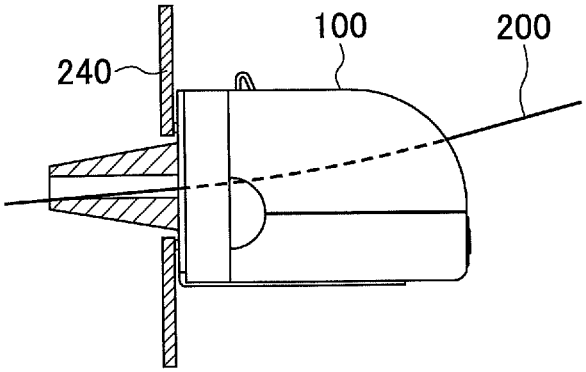
FIG. 51 is a drawing illustrating a printer to which a bezel is connected.

As illustrated in FIG. 50, a presenter 230 may be connected to the printer 100 at a position corresponding to the paper-ejection port 71 of the second case 70. The presenter 230 retracts the recording paper 200 that is not pulled out by a user. Also, as illustrated in FIG. 51, a bezel 240 may be connected to the printer 100 to improve the appearance and the design of the paper-ejection port 71.

<Paper-Feed Port>

Figure 52A:
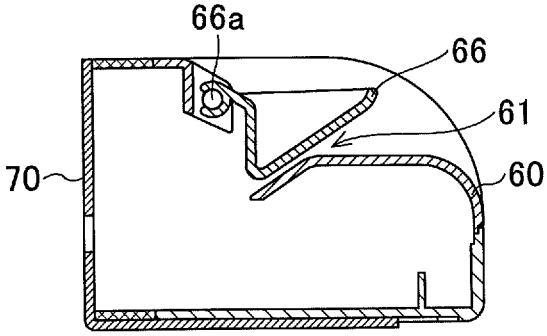
FIG. 52A is a drawing illustrating a flapper.
Figure 52B:
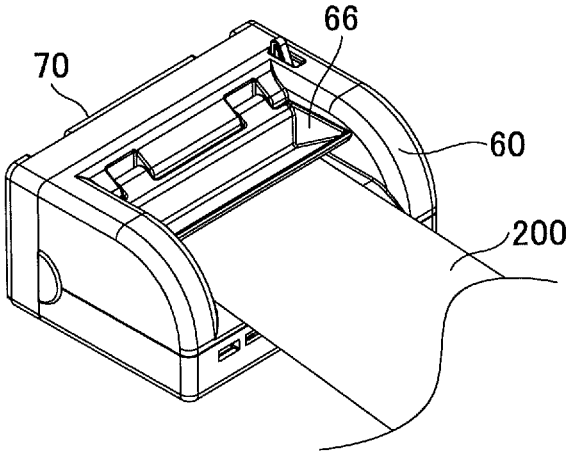
FIG. 52B is a drawing illustrating a flapper.
Figure 53A:
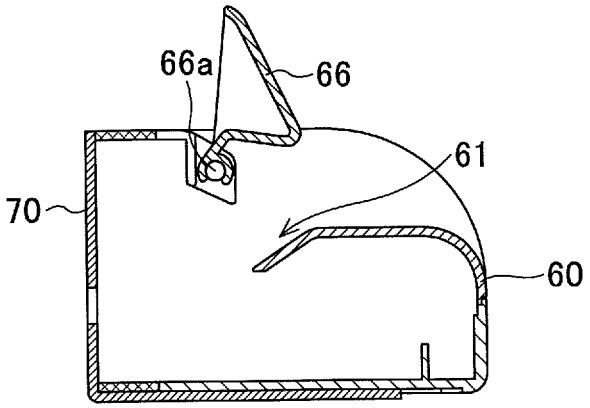
FIG. 53A is a drawing illustrating a flapper.
Figure 53B:
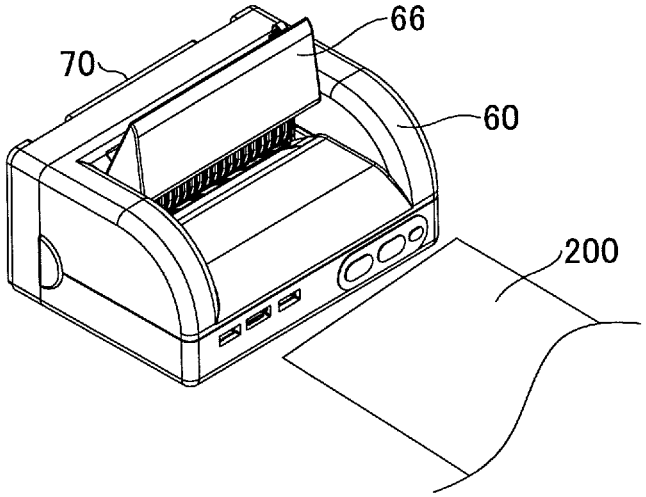
FIG. 53B is a drawing illustrating a flapper.

As illustrated by FIGS. 52A through 53B, the printer 100 of the present embodiment includes a flapper 66 disposed in a position corresponding to the paper-feed port 61 of the first case 60. The flapper 66 is attached to the first case 60 so as to be rotatable about a rotational shaft 66*a*. During printing, as illustrated in FIGS. 52A and 52B, the flapper 66 is closed and functions as a guide for the recording paper 200. For example, when removing the recording paper 200 jammed in the printer 100, the flapper 66 is lifted and opened as illustrated in FIGS. 53A and 53B to widen the paper-feed port 61 and make it easier to remove the recording paper 200.

Figure 54A:
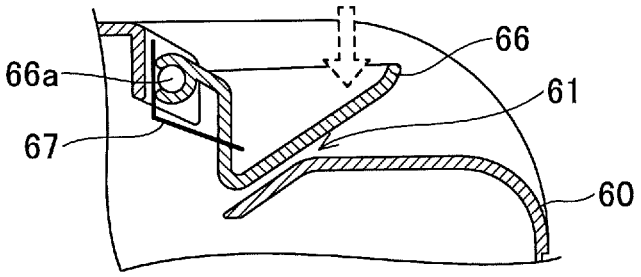
FIG. 54A is a drawing illustrating a flapper.
Figure 54B:
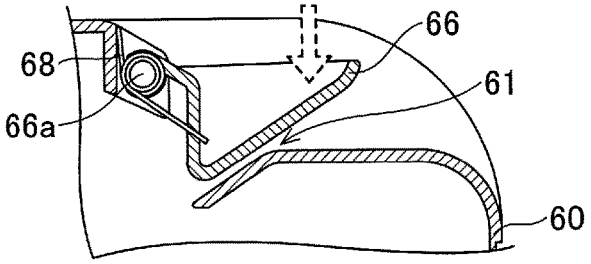
FIG. 54B is a drawing illustrating a flapper.

Also, as illustrated in FIG. 54A, a plate spring 67 for biasing the flapper 66 in the closing direction may be connected to the flapper 66. With the biasing force of the plate spring 67, the flapper 66 can function as a damper for tensioning the recording paper 200 that is fed through the paper-feed port 61. Also, as illustrated in FIG. 54B, a torsion spring 68 may be used in place of the plate spring 67.

Second Embodiment

Figure 55:
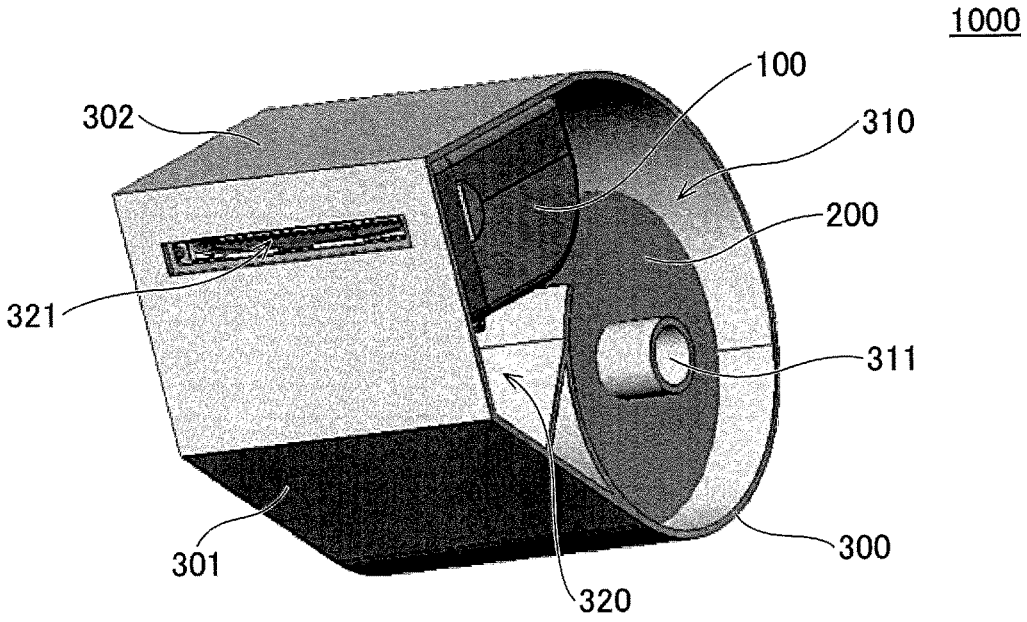
FIG. 55 is a perspective view of a printing device of a second embodiment.
Figure 56:
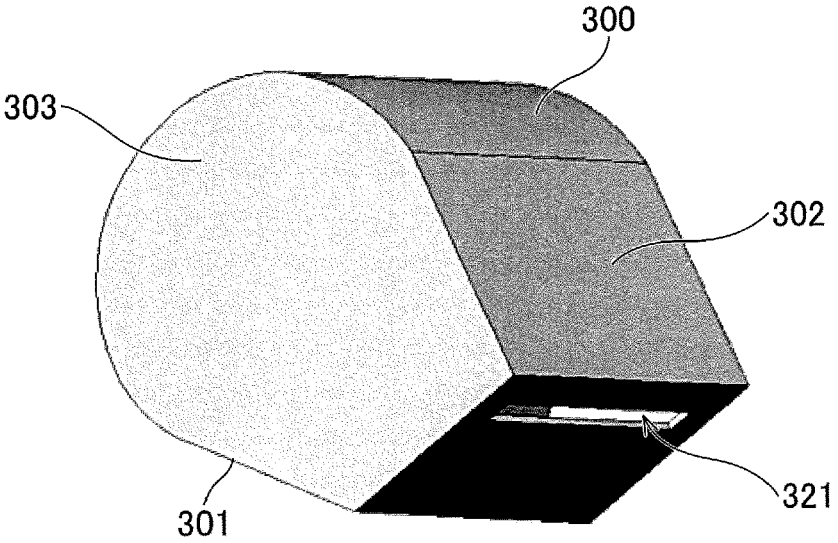
FIG. 56 is a perspective view of a housing of a printing device of the second embodiment.
Figure 57:
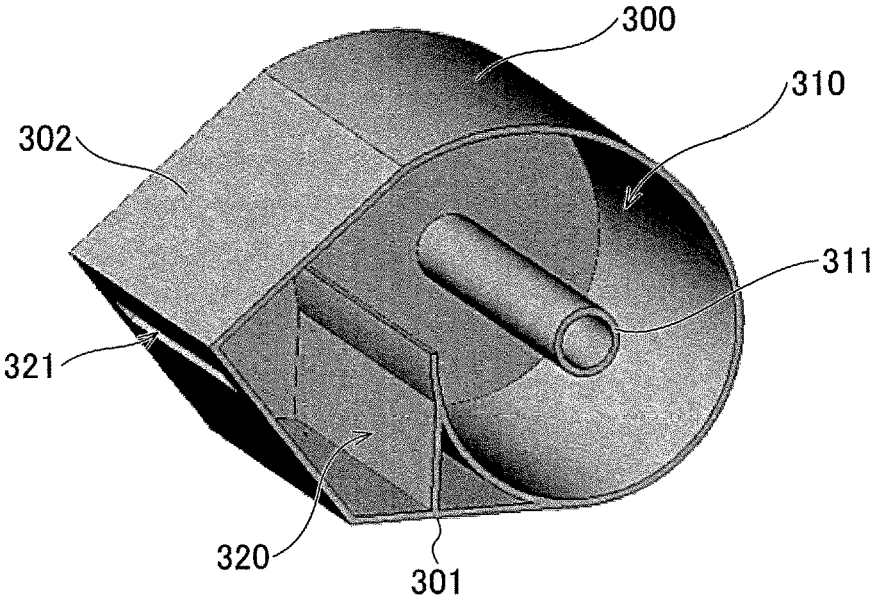
FIG. 57 is a perspective view of a housing of a printing device of the second embodiment.

Next, a printing device 1000 according to a second embodiment is described. FIG. 55 is a perspective view of the printing device 1000, and FIGS. 56 and 57 are perspective views of a housing 300.

The printing device 1000 of the second embodiment includes the housing 300 and the printer 100 of the first embodiment.

In the printing device 1000, the printer 100 and a paper roll 200 are placed in the housing 300. The housing 300 includes an area 310 where the paper roll 200 is placed, and an area 320 where the printer 100 is placed. A paper-feed shaft 311 for supporting the paper roll 200 is provided in the area 310. Recording paper on which information is printed by the printer 100 is ejected from the paper-ejection port 71, and then ejected from a paper-ejection port 321 of the housing 300.

The housing 300 includes flat outer surfaces including a first installation surface 301 and a second installation surface 302. When installing the printing device 1000 on a desk or a wall, the printing device 1000 may be installed such that either the first installation surface 301 or the second installation surface 302 contacts the desk or the wall. Also, a third installation surface 303, which is a side surface of the housing 300, may be placed on the desk or the wall.

Figure 58:
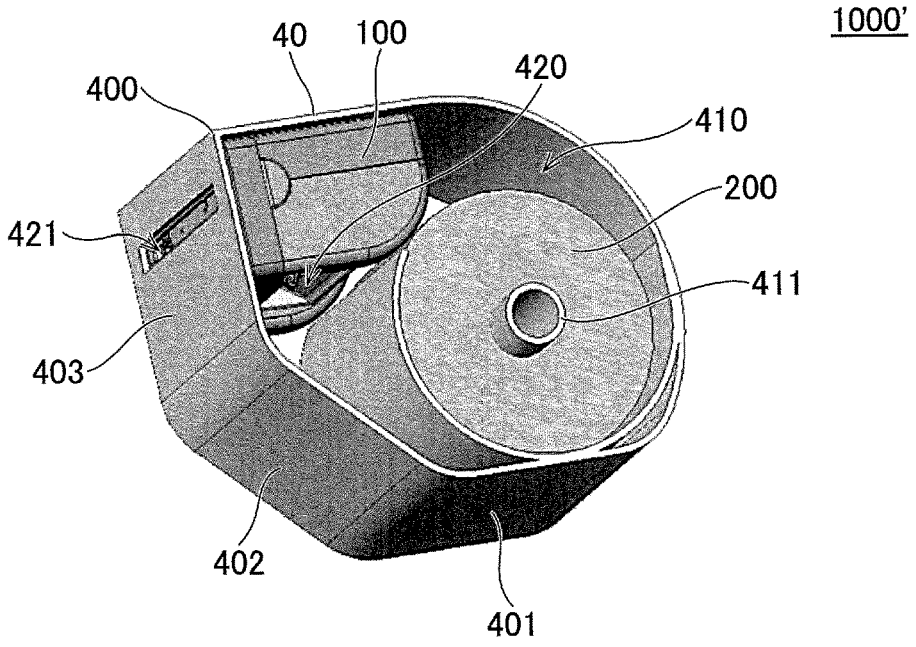
FIG. 58 is a perspective view of a printing device of a variation of the second embodiment.

FIG. 58 is a perspective view of a printing device 1000' of a variation of the second embodiment. The printing device 1000' includes a housing 400 and the printer 100. The paper roll 200 is placed in the housing 400. The housing 400 includes an area 410 where the paper roll 200 is placed, and an area 420 where the printer 100 is placed. A paper-feed shaft 411 is provided in the area 410. Recording paper is ejected from a paper-ejection port 421.

Figure 59A:
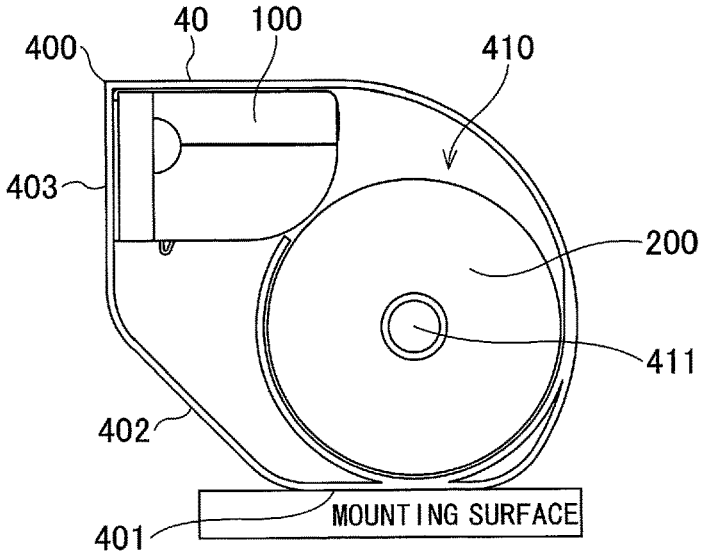
FIG. 59A is a drawing illustrating a way to install a printing device of the variation of the second embodiment.
Figure 59B:
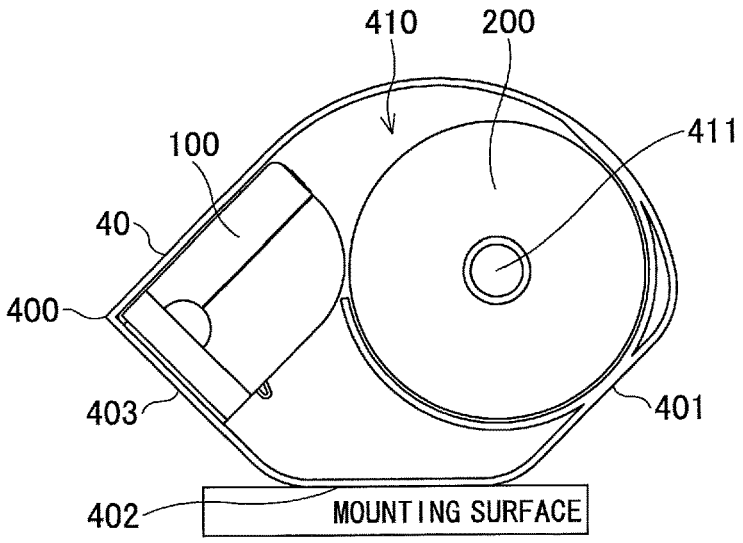
FIG. 59B is a drawing illustrating a way to install a printing device of the variation of the second embodiment.
Figure 59C:
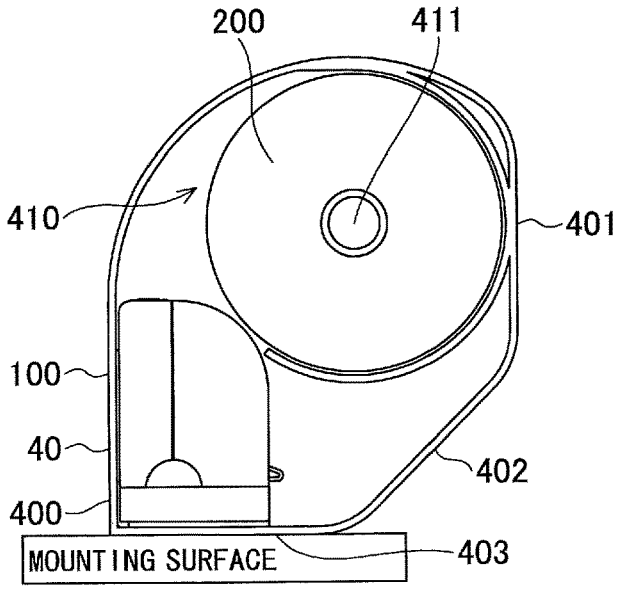
FIG. 59C is a drawing illustrating a way to install a printing device of the variation of the second embodiment.

The housing 400 includes flat outer surfaces including a first installation surface 401, a second installation surface 402, and a third installation surface 403. The printing device 1000' may be installed such that the first installation surface 401 contacts a mounting surface as illustrated in FIG. 59A, the second installation surface 402 contacts the mounting surface as illustrated in FIG. 59B, or the third installation surface 403 contacts the mounting surface as illustrated in FIG. 59C.

Embodiments of the present invention are described above. However, the present invention is not limited to the specifically disclosed embodiments.

The present application is based on and claims the benefit of priority of Japanese Patent Application No. 2015-083273 filed on Apr. 15, 2015, the entire contents of which are hereby incorporated herein by reference.

EXPLANATION OF REFERENCE NUMERALS

10 Thermal head
20 Platen roller
21 Shaft
30 Cutter
40 Feeding motor
50 Cutter motor
60 First case
60*a* Upper case
60*b* Lower case
61 Paper-feed port>
62 Bottom surface
63 Groove
63*a* End
64 Support
65 Screw
66 Flapper
70 Second case
71 Paper-ejection port
72 Bottom surface
73 Sliding part
74 Back surface
80 Opening knob
81 Lock lever
82 Rotational shaft
83 Support
84 Torsion spring
100 Printer
200 Recording paper
1000 Printing device
1000' Printing device

The invention claimed is:

1. A printer, comprising:
a recording head;
a platen roller;
a first case to which the recording head is attached, the first case including a paper-feed port for feeding recording paper;
a second case to which the platen roller is attached, the second case including a paper-ejection port for ejecting the recording paper; and
an operable lock lever that is disposed in the first case and includes a support configured to rotatably support a shaft of the platen roller,
wherein the printer is configured such that
the shaft of the platen roller is placed in the support when the first case and the second case are joined together, and
the shaft of the platen roller is disengaged from the support when the lock lever is operated.

2. The printer as claimed in claim 1, wherein
the second case includes a sliding part;
the first case includes a groove in which the sliding part is placed; and
the printer is configured such that when the lock lever is operated, the sliding part slides in the groove and the second case moves relative to the first case.

3. The printer as claimed in claim 1, further comprising:
a spring configured to bias the recording head toward the platen roller, wherein
the printer is configured such that when the lock lever is operated to disengage the shaft of the platen roller from the support, the recording head is caused to press the platen roller by a biasing force of the spring and thereby causes the first case and the second case to be separated from each other; and a direction in which the spring biases the recording head is different from a direction in which the first case and the second case are separated from each other.

4. The printer as claimed in claim 1, further comprising:

a bezel that is connected to the second case at a position corresponding to the paper-ejection port.

5. The printer as claimed in claim 1, further comprising:

an operations panel and an interface port disposed on one of the first case and the second case.

6. A printing device, comprising:

the printer of claim 1; and a housing including a printer holder that houses the printer, a recording paper holder configured to house recording paper, and a paper-ejection port for ejecting the recording paper.

7. A printer, comprising:

a first case including a recording head;

a second case including a platen roller; and a lock disposed in the first case and configured to support a shaft of the platen roller; and an operable lock lever connected to the lock, wherein the printer is configured such that the first case and the second case are joined together in a state where the shaft is supported by the lock, and the first case is separable from the second case by disengaging the shaft from the lock by operating the lock lever.

8. The printer as claimed in claim 1, further comprising:

an opening knob protruding from the first case and connected to the lock lever, wherein the printer is configured such that the shaft of the platen roller is disengaged from the support when the lock lever is moved by operating the opening knob.

9. The printer as claimed in claim 7, further comprising:

an opening knob protruding from the first case and connected to the lock lever, wherein the printer is configured such that the shaft of the platen roller is disengaged from the lock when the lock lever is moved by operating the opening knob.

* * * * *